US011035194B2

(12) United States Patent
Le

(10) Patent No.: US 11,035,194 B2
(45) Date of Patent: Jun. 15, 2021

(54) PRESSURE CONTROL DEVICE, AND INSTALLATION AND RETRIEVAL OF COMPONENTS THEREOF

(71) Applicant: WEATHERFORD TECHNOLOGY HOLDINGS, LLC., Houston, TX (US)

(72) Inventor: Tuong T. Le, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/199,375

(22) Filed: Nov. 26, 2018

(65) Prior Publication Data

US 2019/0093442 A1 Mar. 28, 2019

Related U.S. Application Data

(63) Continuation of application No. 15/252,499, filed on Aug. 31, 2016, now Pat. No. 10,167,694.

(51) Int. Cl.
*E21B 33/06* (2006.01)
*E21B 33/08* (2006.01)
(Continued)

(52) U.S. Cl.
CPC ..... *E21B 33/06* (2013.01); *E21B 17/01* (2013.01); *E21B 23/01* (2013.01); *E21B 33/085* (2013.01)

(58) Field of Classification Search
CPC ..... E21B 17/01; E21B 23/01; E21B 33/06; E21B 33/085
See application file for complete search history.

(56) References Cited

U.S. PATENT DOCUMENTS 2,266,968 A * 12/1941 Hamilton ..... F16C 17/026 384/412
2,921,633 A 1/1960 Baker
(Continued)

FOREIGN PATENT DOCUMENTS

EP 2216498 A2 8/2010
WO 2016053294 A1 4/2016

OTHER PUBLICATIONS

Smith Services; "HOLD 2500 Rotating Control Device", company brochure, dated 2004, 2 pages.
(Continued)

*Primary Examiner* — Aaron L Lembo
(74) *Attorney, Agent, or Firm* — Smith IP Services, P.C.

(57) ABSTRACT

Conveying a replaceable assembly between latched and unlatched configurations with an outer housing can include connecting the replaceable assembly to a running tool, so the assembly can be conveyed with the running tool, and disconnecting the assembly from the running tool. At least one of the connecting and disconnecting steps can include actuating an iris mechanism. A pressure control device can include an annular seal and a latch that releasably secures the annular seal relative to an outer housing, the latch including a grip member that grips a surface and prevents relative rotation. Another pressure control device can include an annular seal connected to and rotatable with an inner mandrel, and a bearing that permits relative rotation between the annular seal and the outer housing. A structure rotates with the inner mandrel, the structure including a flow inductive profile exposed to a bearing lubricant flow path.

14 Claims, 31 Drawing Sheets

(51) Int. Cl.
*E21B 17/01* (2006.01)
*E21B 23/01* (2006.01)

(56) References Cited

U.S. PATENT DOCUMENTS

| | | | | |
|---|---|---|---|---|
| 3,603,385 | A * | 9/1971 | Jones | E21B 33/035 166/336 |
| 3,991,826 | A | 11/1976 | Baugh | |
| 4,590,995 | A | 5/1986 | Evans | |
| 4,591,197 | A | 5/1986 | Akkerman | |
| 4,836,278 | A | 6/1989 | Stone et al. | |
| 4,842,082 | A | 6/1989 | Springer | |
| 6,230,824 | B1 | 5/2001 | Peterman et al. | |
| 7,159,669 | B2 | 1/2007 | Bourgoyne et al. | |
| 7,487,837 | B2 | 2/2009 | Bailey et al. | |
| 7,699,109 | B2 | 4/2010 | May et al. | |
| 7,735,564 | B2 | 6/2010 | Uerrero | |
| 7,836,946 | B2 | 11/2010 | Bailey et al. | |
| 7,926,593 | B2 | 4/2011 | Bailey et al. | |
| 7,997,345 | B2 | 8/2011 | Hannegan | |
| 8,136,588 | B2 | 3/2012 | Mason | |
| 8,322,432 | B2 | 12/2012 | Bailey et al. | |
| 8,727,303 | B2 | 5/2014 | Araujo et al. | |
| 9,611,708 | B2 | 4/2017 | Rios, III | |
| 10,287,838 | B2 | 5/2019 | Van Bilderbeek et al. | |
| 2003/0106712 | A1 | 6/2003 | Bourgoyne et al. | |
| 2005/0023866 | A1 | 2/2005 | Matusek et al. | |
| 2005/0236158 | A1 | 10/2005 | Miyahara | |
| 2009/0161997 | A1 | 6/2009 | Beauchamp et al. | |
| 2010/0175882 | A1 | 7/2010 | Bailey et al. | |
| 2010/0243235 | A1 | 9/2010 | Caldwell et al. | |
| 2011/0036638 | A1 | 2/2011 | Sokol et al. | |
| 2011/0214871 | A1 | 9/2011 | Leduc et al. | |
| 2012/0013133 | A1 | 1/2012 | Rios, III et al. | |
| 2012/0055677 | A1 | 3/2012 | Boyd | |
| 2012/0085545 | A1 | 4/2012 | Tarique et al. | |
| 2012/0292054 | A1 | 11/2012 | Orbell et al. | |
| 2012/0318496 | A1 | 12/2012 | Bailey et al. | |
| 2014/0014353 | A1 | 1/2014 | Rios, III | |
| 2014/0069720 | A1 | 3/2014 | Gray | |
| 2016/0123399 | A1 | 5/2016 | Arnt et al. | |
| 2016/0245028 | A1 | 8/2016 | Arnt | |
| 2016/0245037 | A1 | 8/2016 | Gray et al. | |
| 2016/0305213 | A1 | 10/2016 | Godfrey et al. | |
| 2017/0114602 | A1 | 4/2017 | Grace | |

OTHER PUBLICATIONS

J.E. Hall; et al.; "Means for Handling Gas Influx in Marine Riser", IADC/SPE 14739, dated Feb. 10-12, 1986, 7 pages.
Joseph A. Cantu, et al.; "Using Rotating Control Devices Safety in Today's Managed Pressure and Underbalanced Drilling Operations", Spe/IADC 91583, dated Oct. 11-12, 2004, 2 pages.
Weatherford; "Bearing Assembly, Running Tool 6-5/8 FH, Running Tool 7800/7875", drawing No. D000414120, dated Jun. 2, 2008, 1 page.
Weatherford; "Assembly, Weldment SRD Joint AGR Chevron", drawing No. D000459938, dated Jul. 15, 2011, 1 page.
International Search Report with Written Opinion dated Dec. 28, 2017 for PCT Patent Application No. PCT/US2017/048407, 16 pages.
European Search Report dated Dec. 2, 2018 for EP Patent Application No. 17170899.3, 11 pages.
Office Action dated May 3, 2018 for U.S. Appl. No. 15/252,499, 21 pages.
Canadian Office Action dated Sep. 24, 2018 for CA Patent application No. 2,965,614, 4 pages.
Office Action dated Jun. 6, 2017 for U.S. Appl. No. 15/153,356, 12 pages.
Office Action dated Apr. 6, 2018 for U.S. Appl. No. 15/153,356, 16 pages.
Office Action dated Jul. 10, 2018 for U.S. Appl. No. 15/153,356, 9 pages.
Office Action dated Nov. 28, 2018 for U.S. Appl. No. 15/153,356, 10 pages.
Office Action dated Mar. 7, 2019 for U.S. Appl. No. 15/850,186, 32 pages.
Advisory Action dated Apr. 4, 2019 for U.S. Appl. No. 15/153,356, 19 pages.
Office Action dated Jun. 28, 2019 for U.S. Appl. No. 15/850,186, 16 pages.
Office Action dated Feb. 5, 2019 for U.S. Appl. No. 15/153,356, 6 pages.
Office Action dated Jan. 17, 2020 for U.S. Appl. No. 15/850,186, 12 pages.

* cited by examiner

PRESSURE CONTROL DEVICE, AND INSTALLATION AND RETRIEVAL OF COMPONENTS THEREOF

CROSS-REFERENCE TO RELATED APPLICATION

This application is a continuation of prior application Ser. No. 15/252,499 filed on 31 Aug. 2016. The entire disclosure of this prior application is incorporated herein by this reference.

BACKGROUND

This disclosure relates generally to equipment utilized and operations performed in conjunction with a subterranean well and, in an example described below, more particularly provides a pressure control device, and tools for installation and retrieval of the pressure control device.

A pressure control device is typically used to seal off an annular space between an outer tubular structure (such as, a riser, a housing on a subsea structure in a riser-less system, or a housing attached to a surface wellhead) and an inner tubular (such as, a drill string, a test string, etc.). At times it may be desired for components (such as, bearings, seals, etc.) of the pressure control device to be retrieved from, or installed in, an outer housing (such as, a riser housing).

Therefore, it will be appreciated that advancements are continually needed in the arts of constructing and operating pressure control devices. In particular, it would be desirable to provide for convenient and efficient installation and retrieval of pressure control device components respectively into and out of an outer housing.

DETAILED DESCRIPTION

Figure 1:
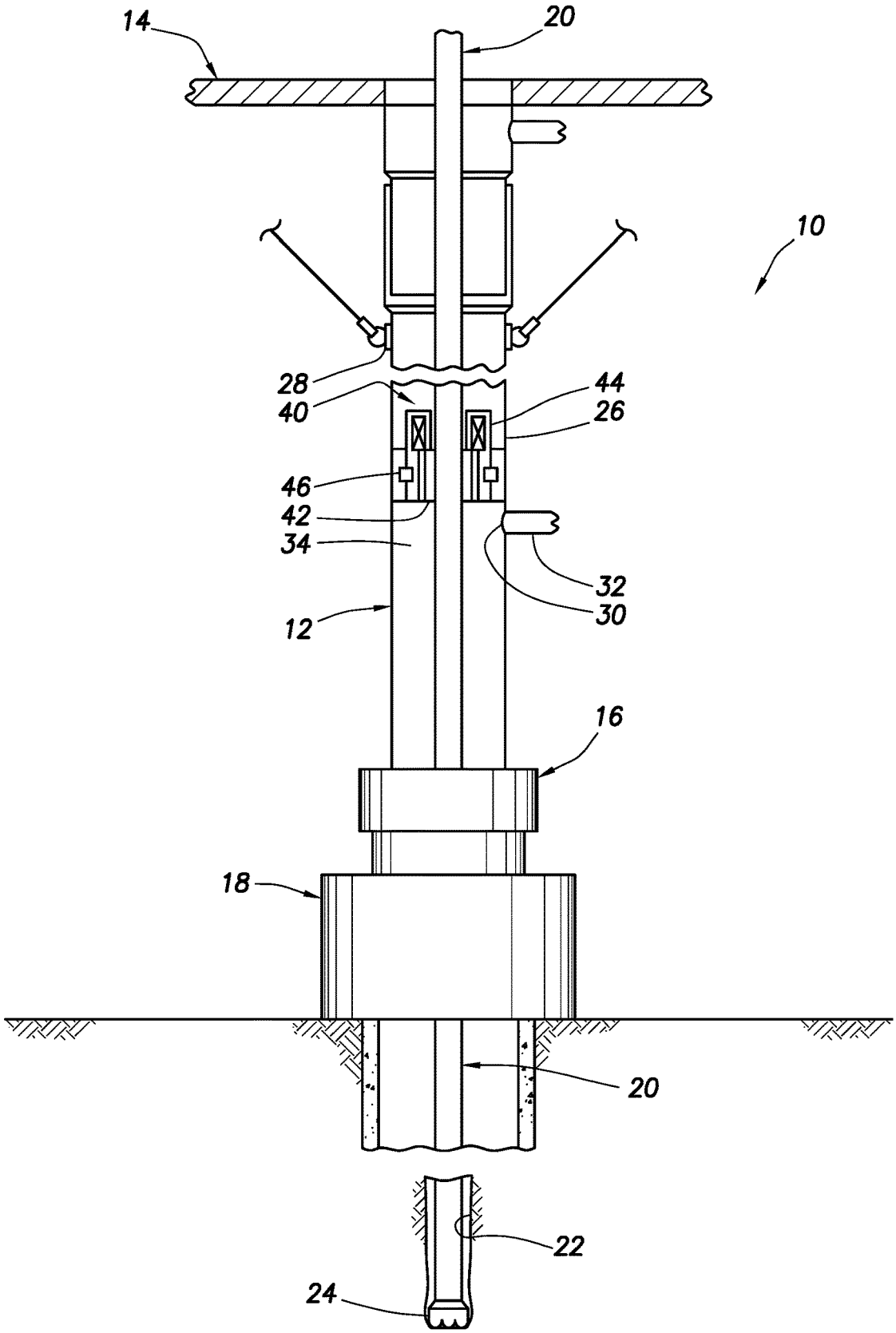
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower end of the tubular string 20.

The drill bit 24 may be rotated by rotating the tubular string 20 (for example, using a top drive or rotary table of the rig 14), and/or a drilling motor may be connected in the tubular string 20 above the drill bit 24.

Furthermore, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes a riser housing 26 connected in the riser string 12 below a tensioner ring 28 suspended from the rig 14. In other examples, the riser housing 26 could be connected above the tensioner ring 28, or could be otherwise positioned (such as, in the wellhead installation 18 in a riser-less configuration). Thus, the scope of this disclosure is not limited to any particular details of the riser string 12 or riser housing 26 as described herein or depicted in the drawings.

The riser housing 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, a releasable assembly 40 is installed in the riser housing 26. The releasable assembly 40 in this example is of the type known to those skilled in the art as a rotating control device.

However, the scope of this disclosure is not limited to installation or retrieval of any particular type of releasable assembly in the riser housing 26. In other examples, the releasable assembly 40 could comprise a protective sleeve (e.g., having no annular seal for engagement with the tubular string 20), or a non-rotating pressure control device (e.g., having one or more non-rotating annular seals for engagement with the tubular string 20).

In the FIG. 1 example, the releasable assembly 40 includes one or more annular seals 42 that seal off the annulus 34 above the side port 30. In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the riser housing 26 is provided for by a bearing assembly 44 of the releasable assembly 40. The annular seals 42 and bearing assembly 44 are releasably secured in the riser housing 26 by a latch 46 of the releasable assembly 40. The latch 46 permits the annular seals 42 and/or the bearing assembly 44 to be installed in, or retrieved from, the riser housing 26 when desired, for example, to service or replace the seals 42 and/or bearing assembly 44.

The tubular string 20 can include running and retrieval tools, examples of which are described more fully below and depicted in FIGS. 2, 3, 6-10, 18, 19 and 22-25, for installing and retrieving the releasable assembly 40. However, it should be clearly understood that the scope of this disclosure is not limited to these particular examples of running and retrieval tools, and is not limited to use of a running or retrieval tool as part of the tubular string 20 of FIG. 1.

Figure 2:
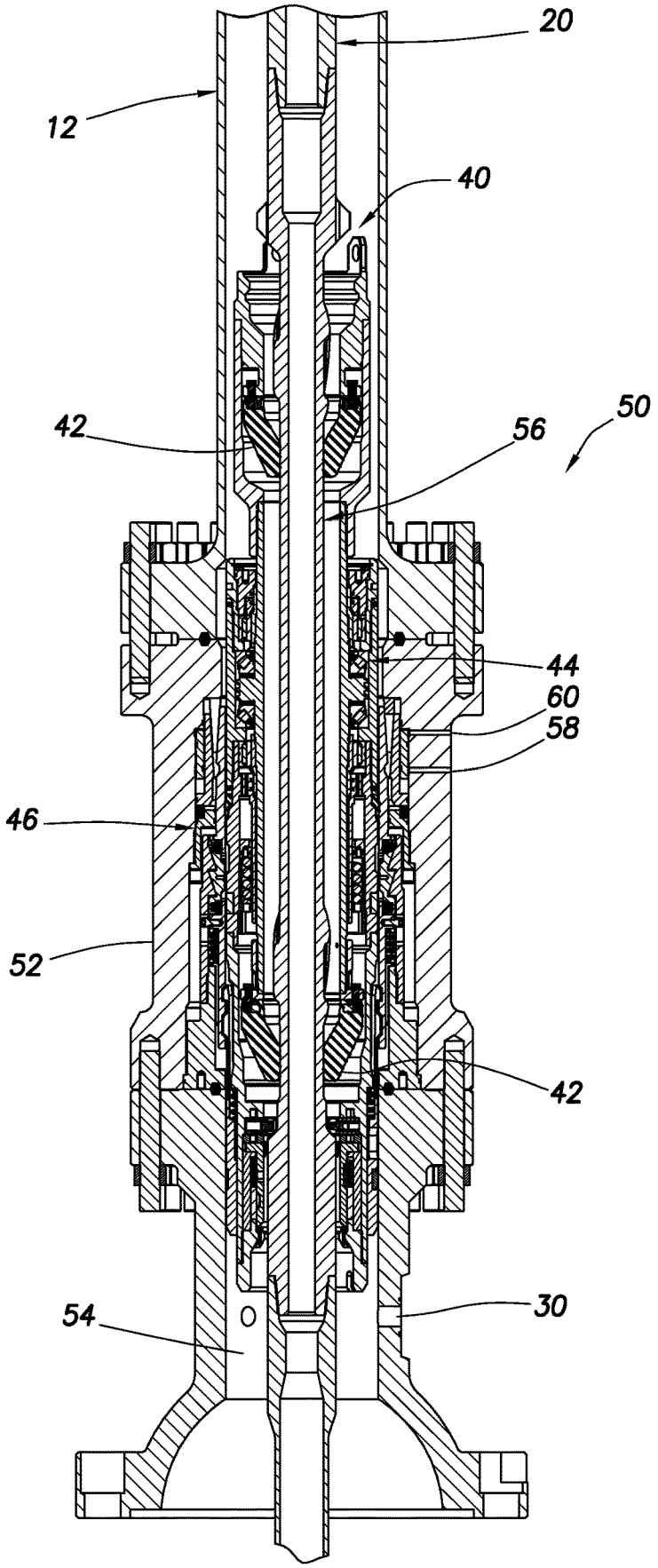
FIG. 2 is a representative cross-sectional view of an example of a replaceable assembly being installed in a pressure control device outer housing.

Referring additionally now to FIG. 2, an example of a pressure control device 50 that may be used in the system 10 and method of FIG. 1 is representatively illustrated. In other examples, the pressure control device 50 could be used with other systems and methods.

FIG. 2 depicts a representative cross-sectional view of an example of the replaceable assembly 40 being installed in an outer housing 52 of the pressure control device 50. When used in the system 10 of FIG. 1, the outer housing 52 could comprise the riser housing 26. In other examples, the outer housing 52 may not be connected in a riser string, or may be in another arrangement with respect to other well equipment.

In the FIG. 2 example, the outer housing 52 comprises multiple sections, a lower one of which has the side port 30 formed therein, and an upper one of which encloses the latch 46 for releasably securing the releasable assembly 40. In other examples, the outer housing 52 could comprise other sections or other numbers of sections (including one), and the outer housing 52 could be positioned within one or more other housings. Thus, the scope of this disclosure is not limited to any particular details of the outer housing 52 as described herein or depicted in the drawings.

The replaceable assembly 40 as depicted in FIG. 2 includes two of the annular seals 42 for sealing engagement with an exterior of the tubular string 20 when it is positioned in a passage 54 formed longitudinally through the pressure control device 50. The annular seals 42 are rotatably supported relative to the outer housing 52 by the bearing assembly 44.

A running tool 56 is connected in the tubular string 20 for conveying the releasable assembly 40 through the riser string 12, and into and out of the outer housing 52. The running tool 56 is used in this example both for installing the releasable assembly 40 in the outer housing 52, and for retrieving the releasable assembly 40 from the outer housing 52 and riser string 12.

As described more fully below, the releasable assembly 40 can be releasably secured in the outer housing 52 by conveying the releasable assembly 40 on the running tool 56 connected in the tubular string 20, engaging the latch 46 to limit further downward displacement of the releasable assembly 40 relative to the outer housing 52, and applying a downwardly directed force to the releasable assembly 40 via the running tool 56 (e.g., by slacking off weight of the tubular string 20 at the rig 14).

When a predetermined downwardly directed force is achieved, the latch 46 is "set," so that the releasable assembly 40 is releasably secured against longitudinal and rotational displacement relative to the outer housing 52. In addition, the running tool 56 is released from the releasable assembly 40, so that the running tool 56 and the remainder of the tubular string 20 can be retrieved from the riser string 12.

When it is desired to retrieve the releasable assembly 40 from the riser string 12 (for example to perform maintenance on or replace the annular seals 42, bearing assembly 44, or the entire releasable assembly 40), the running tool 40 can again be connected in the tubular string 20 and conveyed into the releasable assembly 40. The releasable assembly 40 is then retrieved by applying a predetermined downwardly directed force to the releasable assembly 40 via the running tool 56 (e.g., by slacking off weight of the tubular string 20 at the rig 14), and then applying pressure to the latch 46 (e.g., hydraulic pressure applied via ports 58, 60 formed through the outer housing 52). The predetermined downwardly directed force applied in this retrieval operation may be the same as, or different from, the predetermined downwardly directed force applied in the above-described installation operation.

When a sufficient pressure is applied to the latch 46, the latch 46 disengages and the releasable assembly 40 can be displaced upward relative to the outer housing 52, thereby relieving the previously applied downwardly directed force. This relieving of the downwardly directed force causes an inner dimension of the releasable assembly 40 to decrease, so that an outer dimension of the running tool 56 is prevented from displacing upward through the inner dimension, thereby enabling the releasable assembly 40 to be conveyed upward through the riser string 12 on the running tool 56.

Although the running tool 56 is described herein as being used to both install and retrieve the releasable assembly 40, in other examples different running tools may be used for respectively installing and retrieving the releasable assembly 40, the releasable assembly 40 may not be both installed and retrieved (e.g., the releasable assembly 40 could be only installed or only retrieved), or the releasable assembly 40 may not be retrieved after it is installed. Thus, the scope of this disclosure is not limited to any particular steps performed in any particular order or combination, or to any particular purpose or configuration of the running tool 56.

Figure 3:
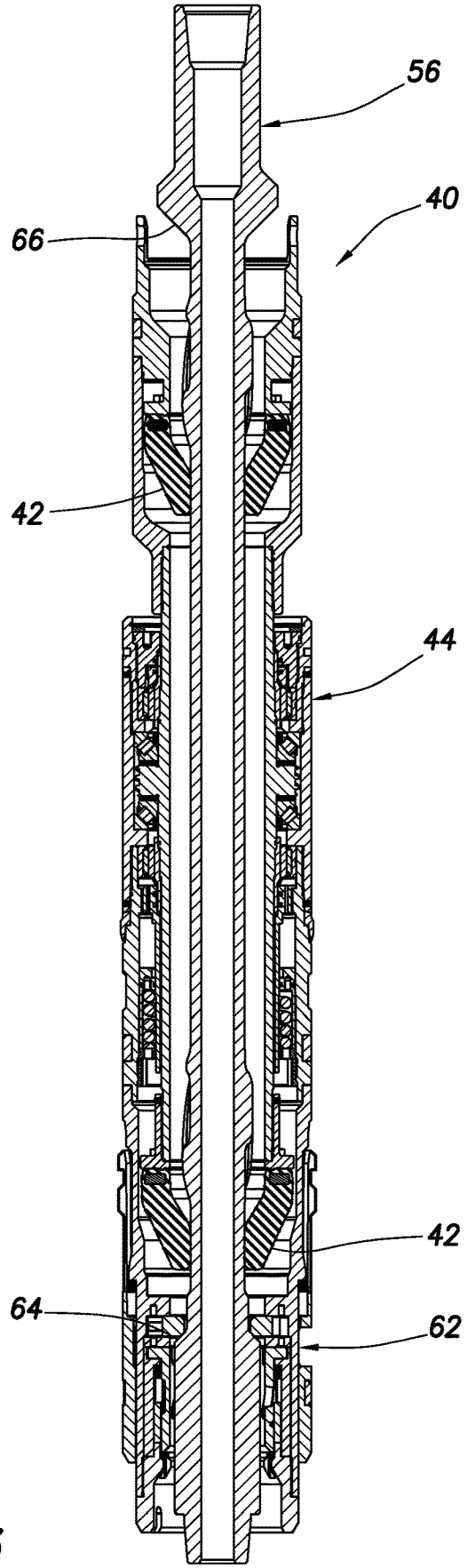
FIG. 3 is a representative cross-sectional view of the replaceable assembly in a run-in configuration suspended on a running tool.

Referring additionally now to FIG. 3, a cross-sectional view of the replaceable assembly 40 in a run-in configuration suspended on the running tool 56 is representatively illustrated. In this configuration, the releasable assembly 40 may be either installed in or retrieved from the outer housing 52 of FIG. 2.

As depicted in FIG. 3, the releasable assembly 40 includes an iris mechanism 62 for varying the inner dimension of the releasable assembly 40. In the FIG. 3 configuration, an external shoulder 64 formed on the running tool 56, and having an outer dimension larger than a reduced inner dimension of the releasable assembly 40, engages the iris mechanism 62 and thereby prevents the running tool 56 from displacing upward relative to the releasable assembly 40.

Thus, the replaceable assembly 40 can be conveyed into or out of the outer housing 52 on the running tool 56. In addition, the running tool 56 has another external shoulder 66 formed thereon. The external shoulder 66 can engage an internal shoulder 68 formed in the releasable assembly 40, to enable the downwardly directed force to be applied from the running tool 56 to the releasable assembly 40 during the installation and retrieval operations.

Figure 4:
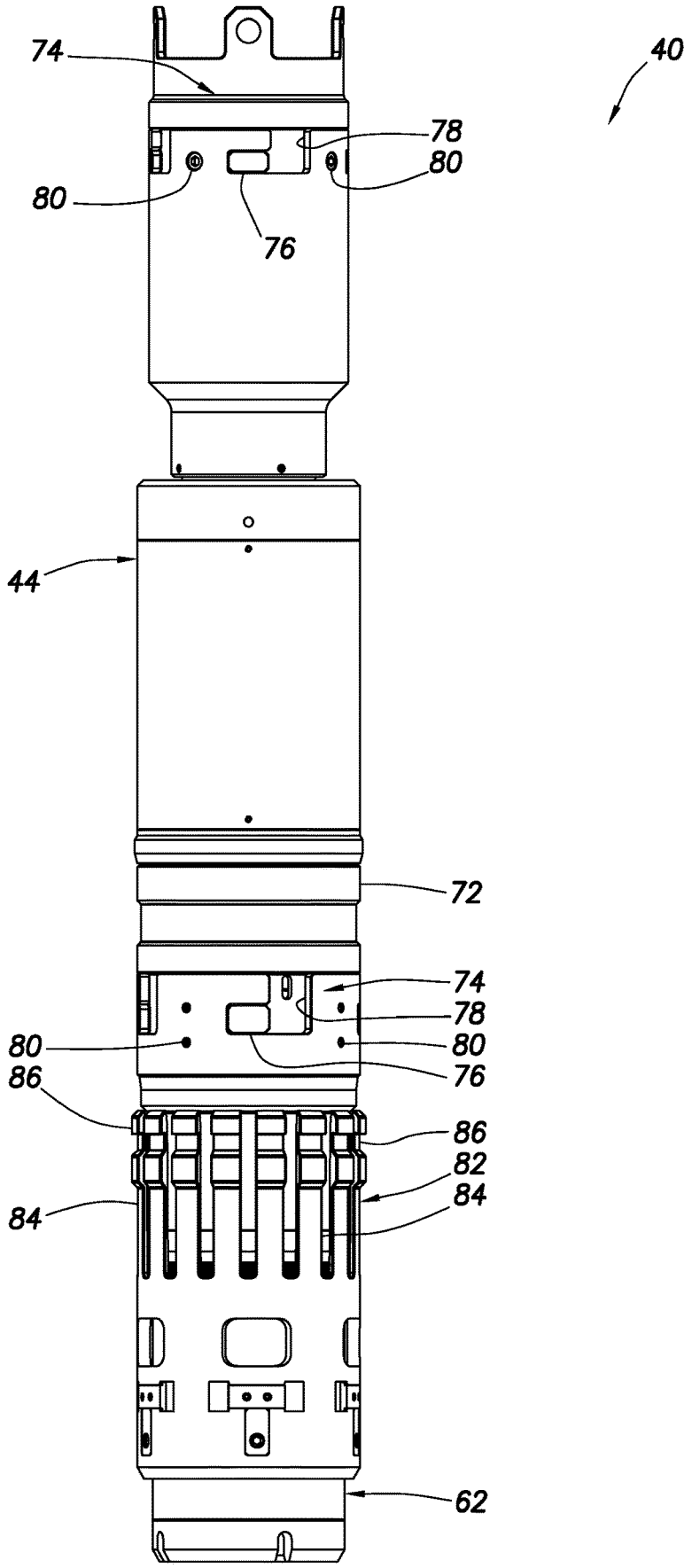
FIG. 4 is a representative elevational view of the replaceable assembly.
Figure 5:
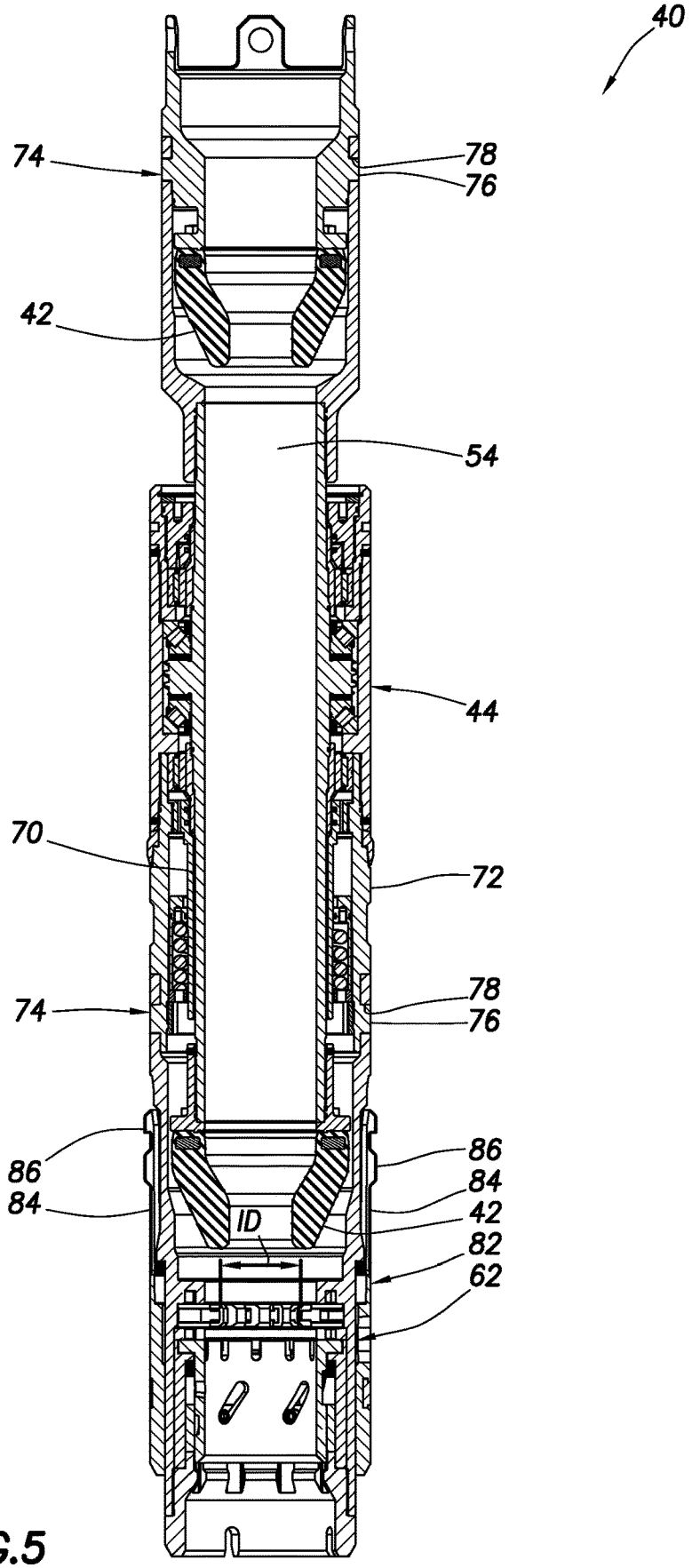
FIG. 5 is a representative cross-sectional view of the replaceable assembly.

Referring additionally now to FIGS. 4 & 5, representative elevational and cross-sectional views of the replaceable assembly 40 are representatively illustrated. In these views, it may be seen that the annular seals 42 are connected to a generally tubular inner mandrel 70, which is rotatably supported in an outer housing 72 by the bearing assembly 44.

The outer housing 72 may include any number of sections (including one) and may be otherwise configured. Thus, the scope of this disclosure is not limited to any particular details of the outer housing 72 or any other components of the releasable assembly 40 as described herein or depicted in the drawings.

The annular seals 42 are conveniently accessible for installation or replacement by means of circumferentially distributed "J" locks 74. Each of the J locks 74 includes lugs 76 and "J" or "L"-shaped slots 78 for providing access to the annular seals 42 in the releasable assembly 40. Fasteners 80 (such as, screws or bolts) can be used to retain the J locks 74 in locked configurations.

In FIGS. 4 & 5, it may also be seen that the releasable assembly 40 includes a collet mechanism 82 comprising multiple circumferentially distributed flexible collets 84. Each of the collets 84 has an external profile 86 formed thereon for cooperative engagement in the latch 46 (see FIG. 2).

As described more fully below, the collet mechanism 82 is configured to initiate setting of the latch 46, and to actuate the iris mechanism 62. The collets 84 are biased downward relative to the outer housing 72, so that the iris mechanism 62 is in an expanded configuration (e.g., in which its inner dimension ID is increased or at a maximum) only when the outer housing 72 and most of the remainder of the releasable assembly 40 is displaced downward relative to the collets 84. Such downward displacement relative to the collets 84 occurs during the installation operation, when the predetermined downwardly directed force is applied to the releasable assembly 40 to set the latch 46.

Figure 6:
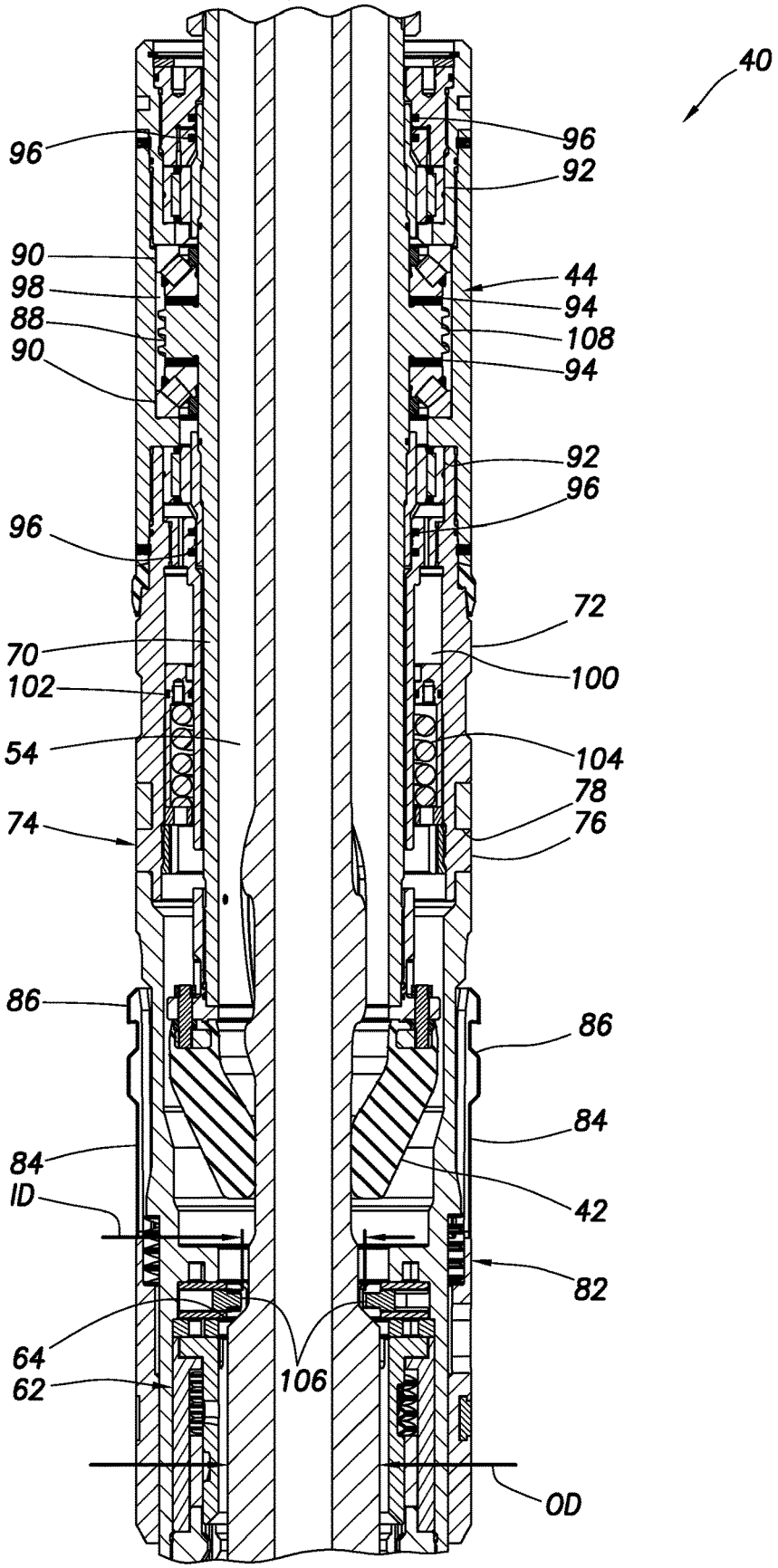
FIG. 6 is a representative cross-sectional view of a section of the replaceable assembly.

Referring additionally now to FIG. 6, a cross-sectional view of a section of the replaceable assembly 40 is representatively illustrated, with the running tool 56 therein. In this view, further details of the bearing assembly 44, iris mechanism 62 and collet mechanism 82 may be seen.

A radially enlarged annular structure 88 formed on the inner mandrel 70 is axially or longitudinally supported between two thrust bearings 90 of the bearing assembly 44. The inner mandrel 70 is also radially supported by radial bearings 92. Thus, the inner mandrel 70 (and the connected annular seals 42) can rotate freely within the outer housing 72, but the inner mandrel 70 is prevented from displacing substantially axially relative to the outer housing 72 (although very limited axial displacement may be possible, e.g., with springs (such as Bellville springs) 94 positioned between the annular structure 88 and each of the bearings 90 to compensate for manufacturing tolerances and nominal clearances).

Rotary seals 96 seal off opposite ends of a lubricant-filled lubricant flow path 98 exposed to the bearings 90, 92. In this example, the rotary seals 96 may be of the type known to those skilled in the art as "controlled leakage" rotary seals that provide for a limited amount of leakage, so that the sealing contact between the seals and the seal surfaces they engage is continuously flushed of debris and lubricated, although other types of rotary seals may be used in other examples.

The lubricant flow path 98 is in communication with a pressurized lubricant chamber 100, so that the lubricant flow path 98 is continuously supplied with lubricant from the lubricant chamber 100. The lubricant chamber 100 is pressurized by means of an annular piston 102 that is biased toward the chamber 100 by a biasing force exerted by a spring 104.

Opposite the chamber 100, the piston 102 is exposed to pressure in the passage 54 below the lower annular seal 42. In this manner, during drilling or other operations, when the annular seal 42 is sealingly engaged with the tubular string 20 (see FIG. 1), the lubricant chamber 100 will be pressurized to a level equal to the pressure in the passage 54 below the lower annular seal 42 (which in the FIG. 1 system 10 is also the pressure in the annulus 34) exposed to the piston 102, plus a pressure due to the biasing force exerted on the piston 102 by the spring 104. Thus, there is always a positive pressure differential from the lubricant flow path 98 and chamber 100 to the passage 54.

As the inner mandrel 70 rotates (due, for example, to rotation of the tubular string 20 in the passage 54 while engaged by the annular seals 42), a flow inductive profile 108 formed on the annular structure 88 induces the lubricant to flow through the flow path 98. In this manner, the lubricant is continuously circulated about the bearings 90, 92 as the inner mandrel 70 rotates.

The flow inductive profile 108 could in some examples be provided as a relatively coarse helical thread on the annular structure 88. In other examples, the profile 108 could comprise multiple vanes or a flow inducing rotor. Any type of flow inductive profile may be used in keeping with the scope of this disclosure.

Note that, in the FIG. 6 example, the inner dimension ID of the iris mechanism 62 is less than the outer dimension OD of the running tool 56. The shoulder 64 will, thus, engage iris segments 106 of the iris mechanism 62 and thereby prevent downward displacement of the releasable assembly 40 relative to the running tool 56.

As described more fully below, the iris segments 106 displace radially inward and radially outward to thereby decrease and increase, respectively, the inner dimension ID. As viewed in FIG. 6, the iris segments 106 are in a retracted configuration, in which the inner dimension ID is at a minimum, and less than the outer dimension OD. In an expanded configuration, the inner dimension ID can be at a maximum, and greater than the outer dimension OD, so that the running tool 56 can displace upwardly through the passage 54 and out of the replaceable assembly 40.

Figure 7A:
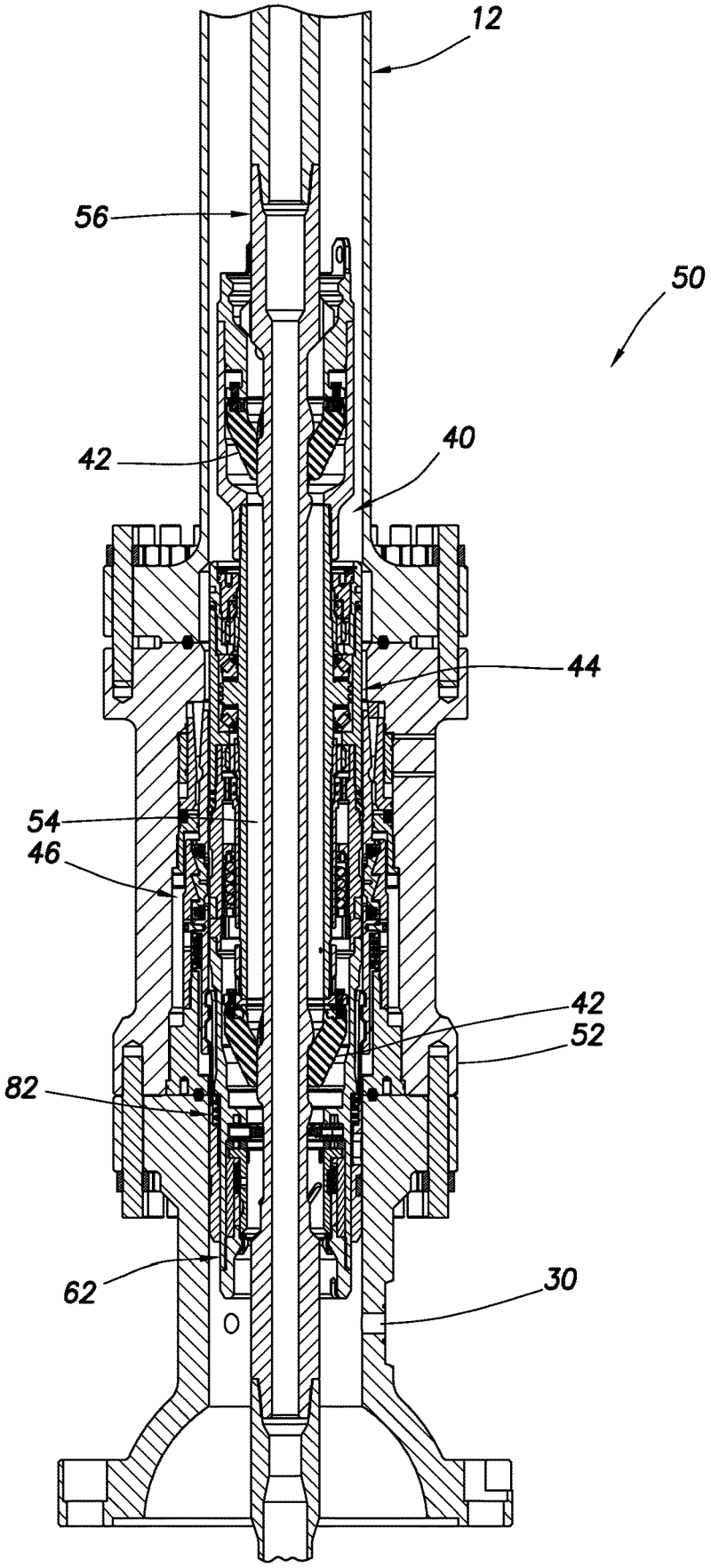
FIGS. 7A & B are representative cross-sectional views of the replaceable assembly as landed and set, respectively, in the outer housing.

Referring additionally now to FIGS. 7A & B, cross-sectional views of the replaceable assembly 40 as landed and set, respectively, in the outer housing 52 are representatively illustrated. These landed and set configurations occur during installation of the replaceable assembly 40 in the outer housing 52.

In FIG. 7A, the replaceable assembly 40 has been conveyed into the outer housing 52 on the running tool 56 (with the iris mechanism 62 in its retracted configuration as depicted in FIG. 6). The collet mechanism 82 has engaged the latch 46. As described more fully below, the profiles 86 (see FIG. 6) of the collet mechanism 82 engage a complementarily shaped internal profile in the latch 46, and this engagement substantially limits further downward displacement of the replaceable assembly 40 relative to the outer housing 52.

Figure 7B:
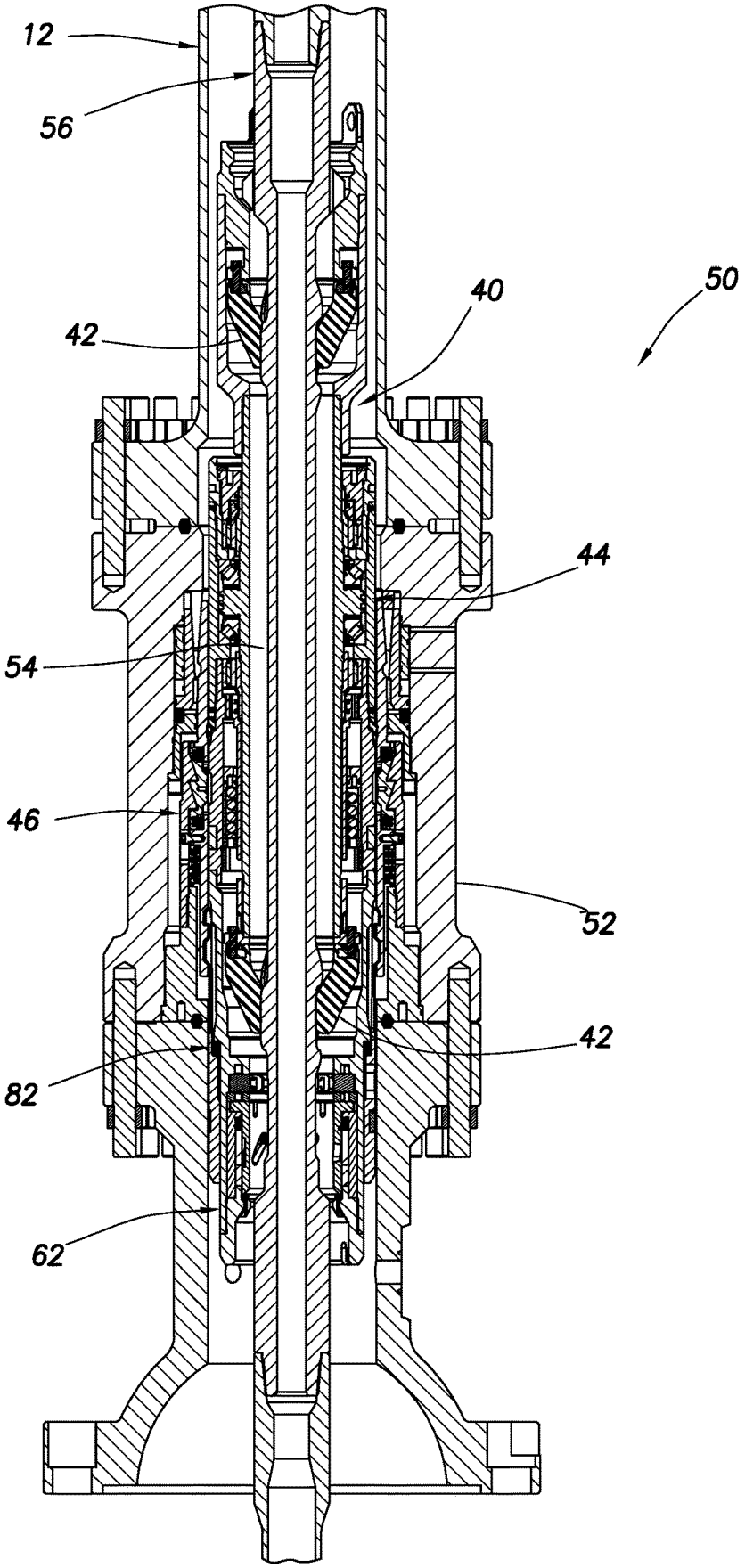

In FIG. 7B, a predetermined downwardly directed force has been applied to the replaceable assembly 40, so that the latch 46 is set, thereby releasably securing the replaceable assembly 40 against longitudinal and rotational displacement relative to the outer housing 52. In addition, the iris mechanism 62 is actuated to its expanded configuration, thereby allowing the running tool 56 to be retrieved from the releasable assembly 40 and riser string 12.

Figure 8A:
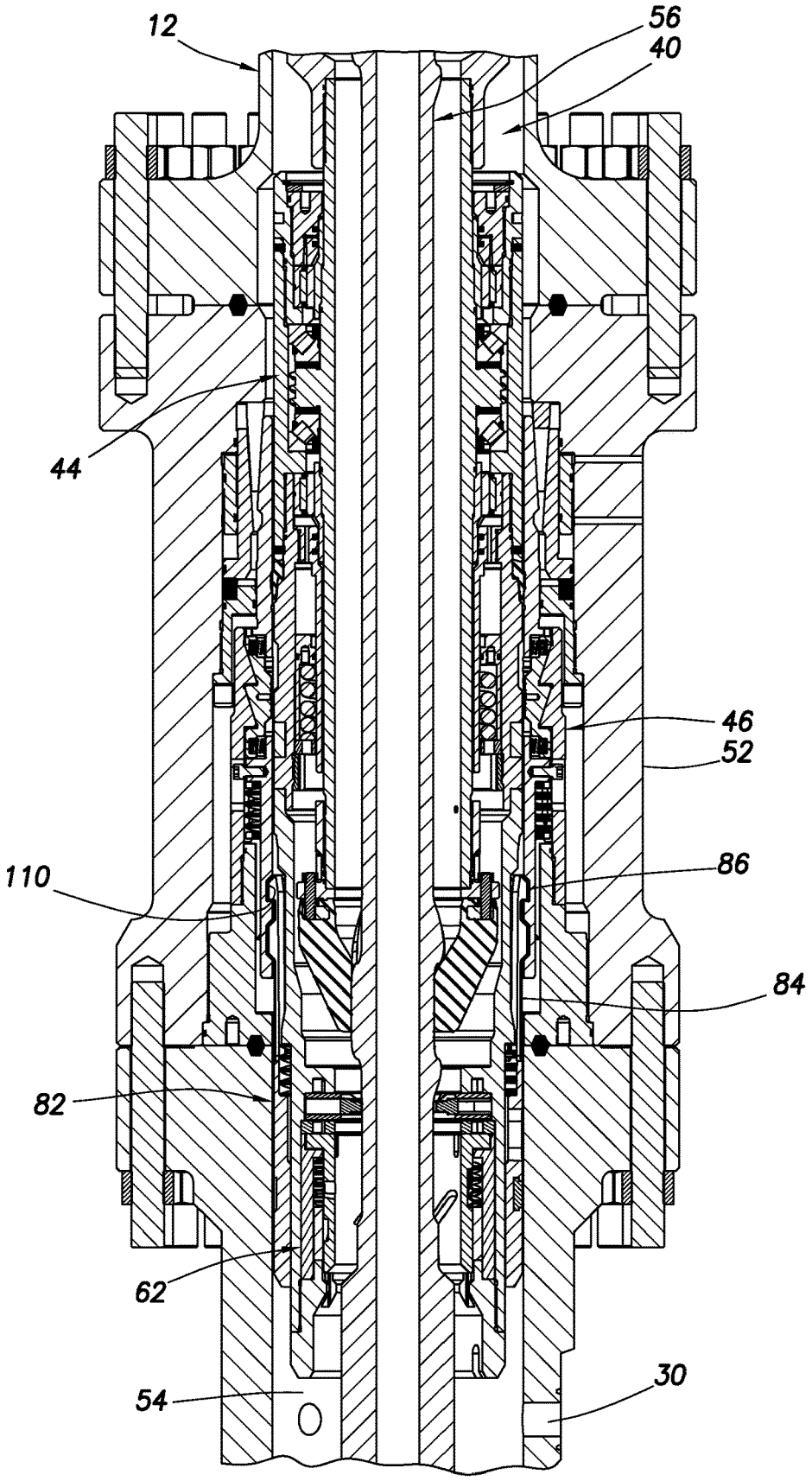
FIGS. 8A & B are representative cross-sectional views of a section of the replaceable assembly in respective landed and set configurations.

Referring additionally now to FIGS. 8A & B, cross-sectional views of a section of the replaceable assembly 40 in the respective landed and set configurations are representatively illustrated. In these views, the manner in which the replaceable assembly 40 engages the latch 46 and the latch is set in response to the downwardly directed force may be more clearly seen.

In FIG. 8A, it may be seen that, when the replaceable assembly 40 is conveyed downwardly into the outer housing 52, the external profiles 86 on the collets 84 cooperatively engage an internal profile 110 in the latch 46. This engagement between the profiles 86, 110 enables further downward displacement of the releasable assembly 40 to be used to set the latch 46 and actuate the iris mechanism 62 to its expanded configuration.

Figure 8B:
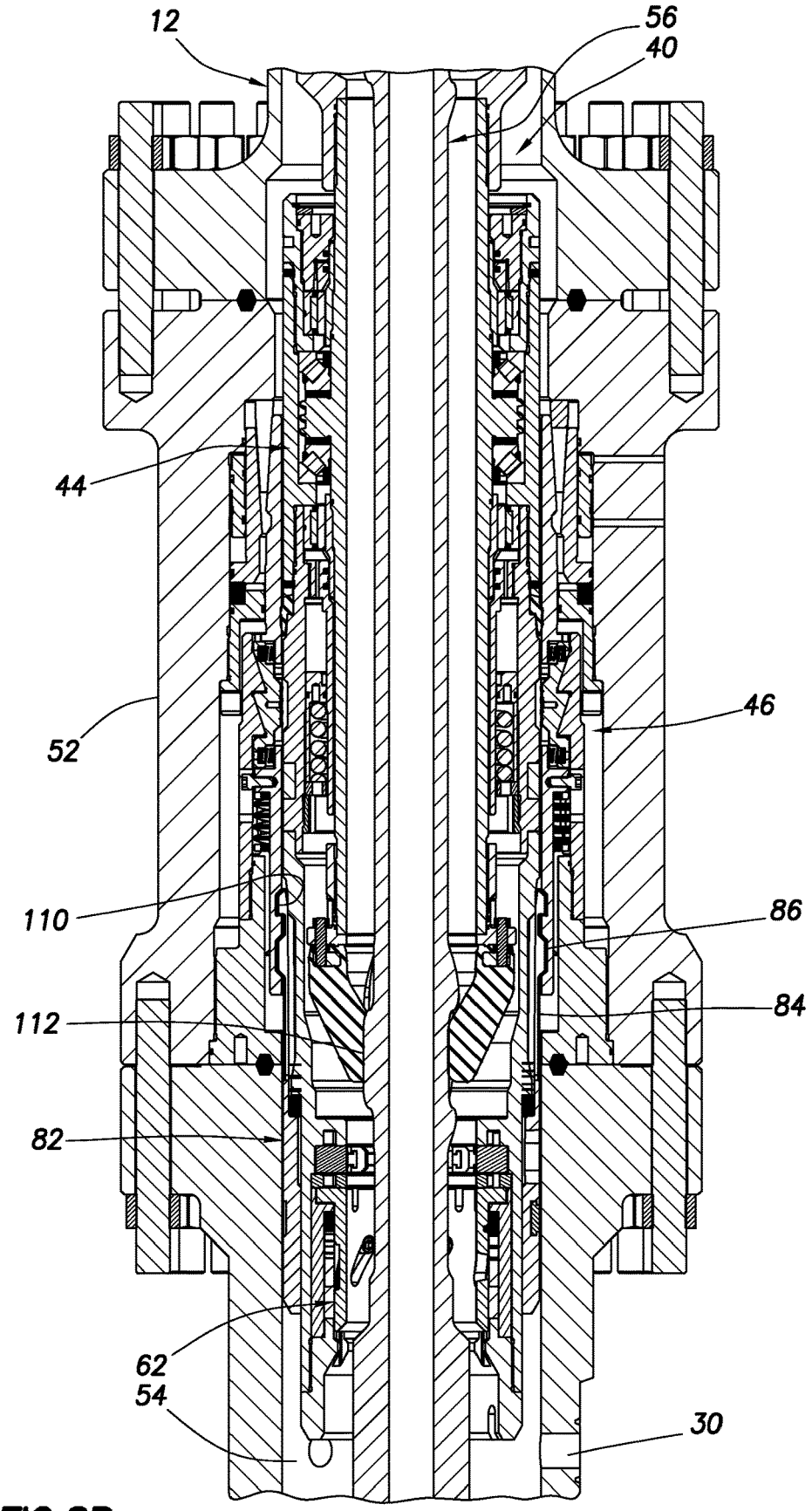

In FIG. 8B, it may be seen that the replaceable assembly 40 has been displaced downward somewhat (relative to the FIG. 8A landed configuration) relative to the outer housing 52, due to the predetermined downwardly directed force being applied to the replaceable assembly 40. The latch 46 is now set, releasably securing the releasable assembly 40 in the outer housing 52. The iris mechanism 62 is also actuated to its expanded configuration, so that the running tool 56 may now be retrieved from the releasable assembly 40 and the riser string 12.

Note that, when the latch 46 is set, helical flutes 112 formed externally on the running tool 56 are positioned within each of the annular seals 42. The helical flutes 112 prevent the annular seals 42 from fully sealingly engaging the exterior of the running tool 56, thereby preventing a pressure differential from building up across the annular seals 42 during the installation and retrieval operations.

Figure 9:
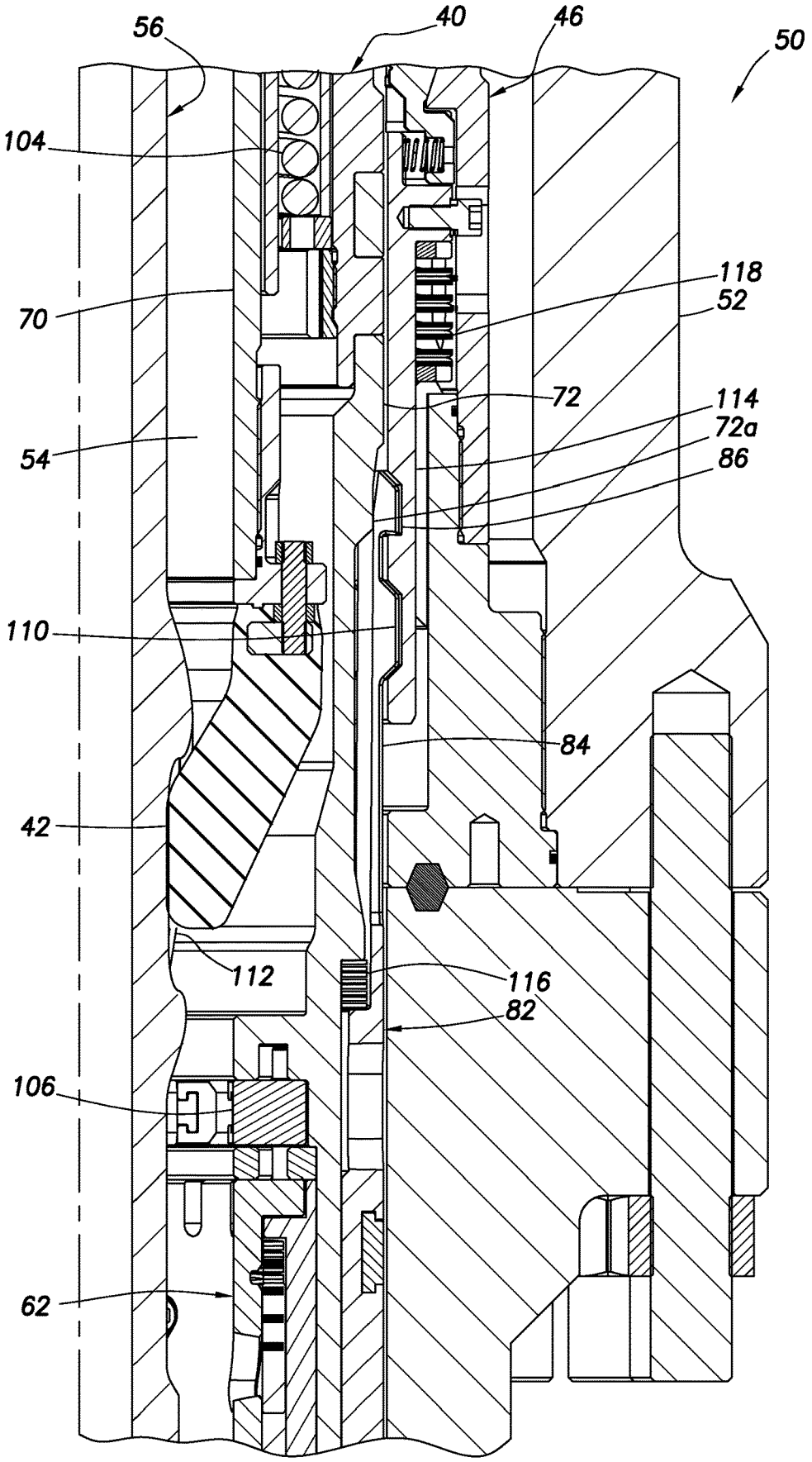
FIG. 9 is a representative cross-sectional view of a lower latch section of the pressure control device.

Referring additionally now to FIG. 9, a representative cross-sectional view of a lower latch section of the pressure control device 50 is representatively illustrated in the landed configuration. In this view, the engagement between the profiles 86, 110 can be more clearly seen.

Note that the profiles 86, 110 are configured such that the profile 86 will engage the profile 110 as the collet mechanism 82 displaces downward through the latch 46. After the profiles 86, 110 are engaged in this manner, further downward displacement of the collet mechanism 82 and the remainder of the releasable assembly 40 will cause a setting sleeve 114 (in which the profile 110 is formed) to displace downward also, in order to set the latch 46.

The collets 84 are biased downward by a spring 116, and the setting sleeve 114 is biased upward by a spring 118. After the profiles 86, 110 are engaged with each other and the downwardly directed force is applied to the releasable assembly 40, the spring 116 is compressed (due to downward displacement of the releasable assembly 40 relative to the collets 84), and the spring 118 is compressed (due to downward displacement of the setting sleeve 114 with the collets 84).

The downward displacement of the releasable assembly 40 relative to the collets 84 actuates the iris mechanism 62 to its expanded configuration in which the iris segments 106 are displaced radially outward. In addition, upper ends of the collets 84 are now positioned between the internal profile 110 and a radially enlarged portion 72*a* of the outer housing 72, so that the external profiles 86 are prevented from disengaging from the internal profiles 110.

Figure 10:
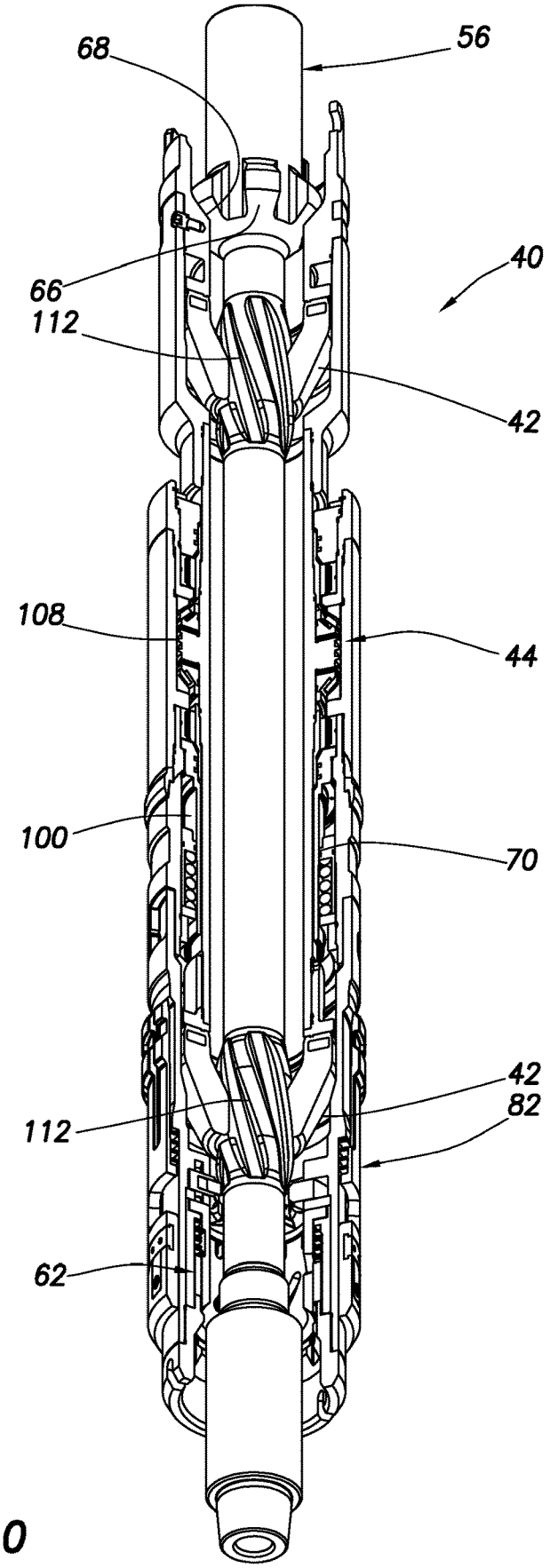
FIG. 10 is a representative partial cross-sectional view of the replaceable assembly and running tool in the landed configuration.

Referring additionally now to FIG. 10, a representative partial cross-sectional view of the replaceable assembly 40 and running tool 56 in the landed configuration is representatively illustrated. In this view, the manner in which the flutes 112 on the running tool 56 prevent a pressure differential from being formed across each of the annular seals 42 can be more clearly seen.

Figure 11A:
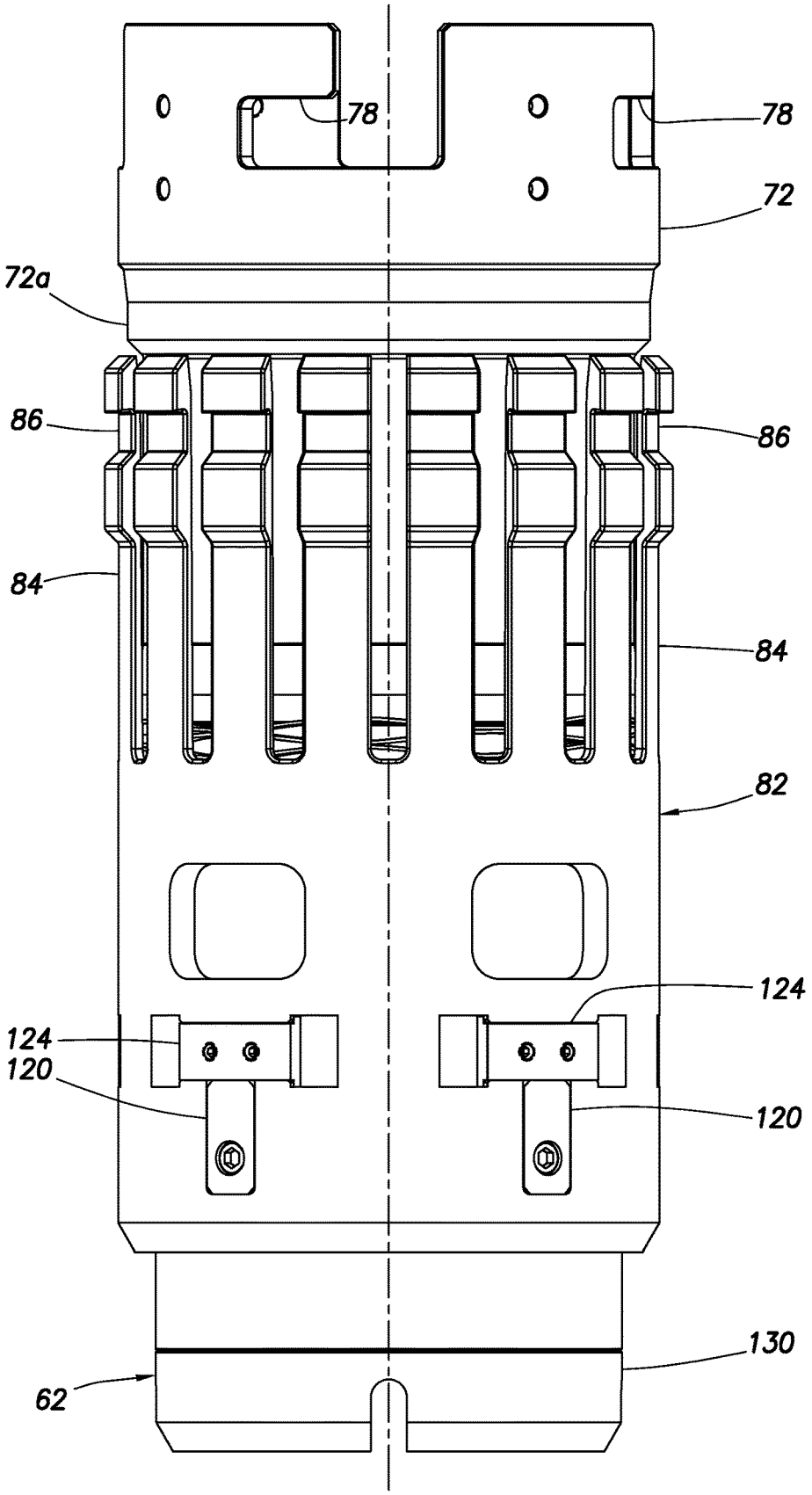
FIGS. 11A-C are representative elevational, longitudinal cross-sectional and lateral cross-sectional views, respectively, of a collet and iris mechanism section of the pressure control device.
Figure 11B:
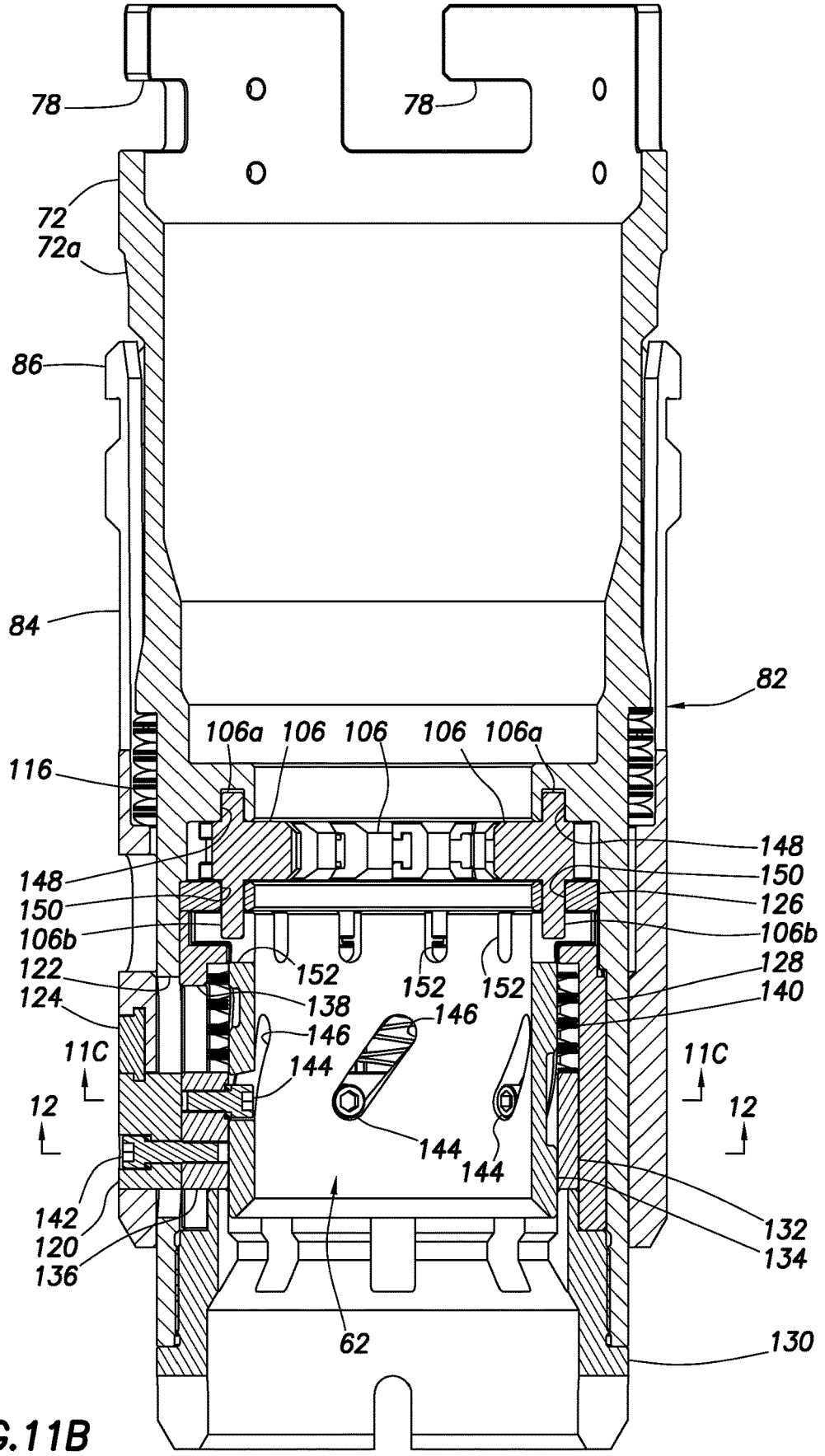
Figure 11C:
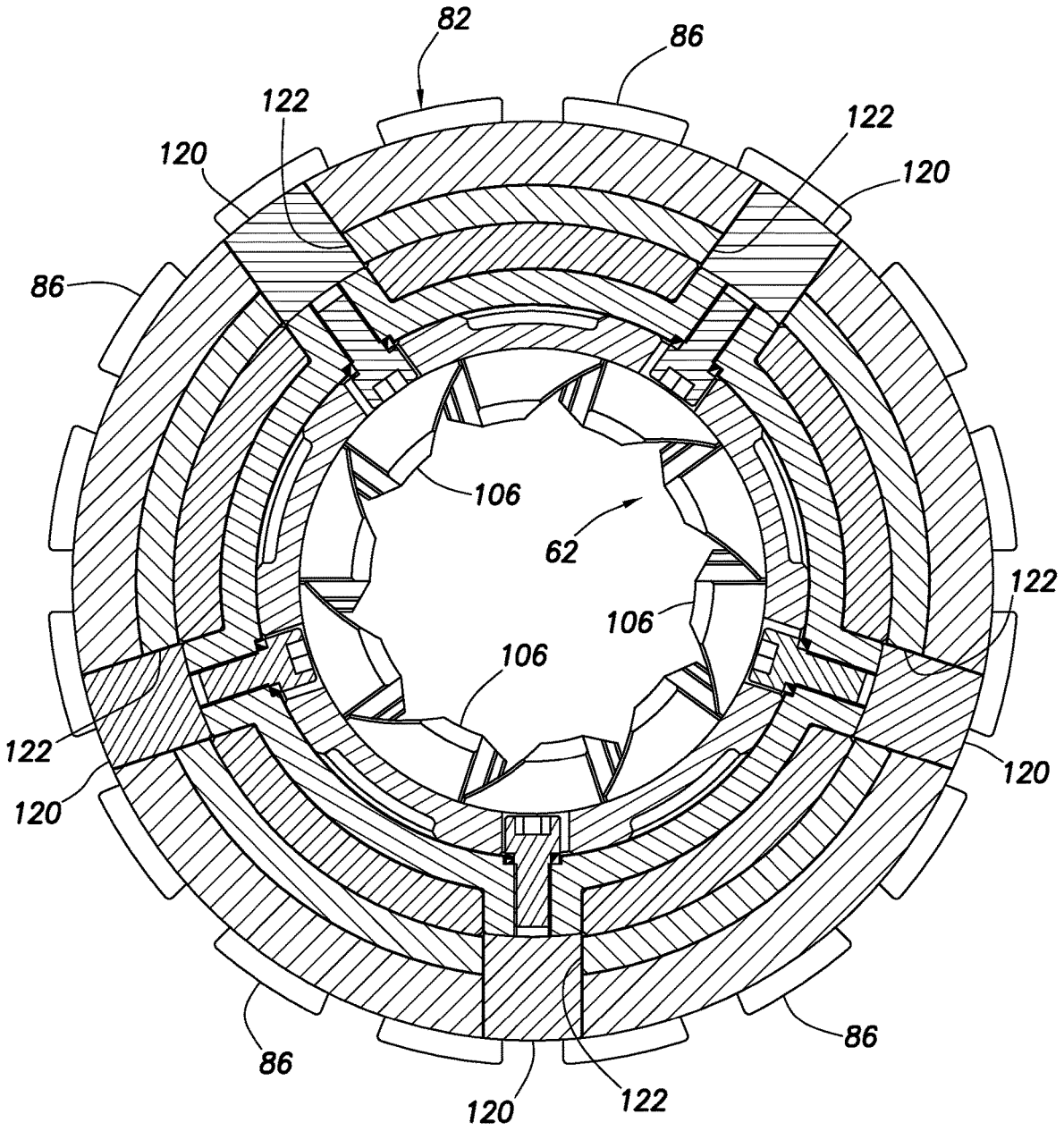

Referring additionally now to FIGS. 11A-C, representative elevational, longitudinal cross-sectional and lateral cross-sectional views, respectively, of the iris and collet mechanisms 62, 82 of the releasable assembly 40 are representatively illustrated. In these views, the manner in which the iris and collet mechanisms 62, 82 operate together can be more clearly seen.

As mentioned above, the collets 84 are biased downward relative to the housing 72 by the spring 116. The collets 84 are prevented from rotating relative to the housing 72 by keys 120 slidingly received in longitudinally elongated slots 122. Keepers 124 secure the keys 120 to the collets 84. Thus, the collets 84 can displace longitudinally somewhat relative to the housing 72, but cannot rotate relative to the housing 72.

A drive plate 126 and a guide sleeve 128 of the iris mechanism 62 are also prevented from rotating relative to the housing 72, and are retained in the housing 72 by a retainer sleeve 130. A drive sleeve 132 positioned between the guide sleeve 128 and a drive hub 134 has keys 136 formed thereon which slidingly engage longitudinally extending slots 138 in the guide sleeve 128. Thus, the drive sleeve 132 can displace longitudinally somewhat relative to the housing 72 and guide sleeve 128, but is prevented from rotating relative to the housing 72 and guide sleeve 128.

The drive sleeve 132 is biased downwardly by a biasing force exerted by a spring 140. Each of the keys 120 is secured to the drive sleeve 132 by a fastener 142 that extends through the key 120 and into a corresponding one of the keys 136. Thus, the collets 84 and drive sleeve 132 displace longitudinally together, and are biased downward by the springs 116, 140.

Fasteners 144 are secured to the drive sleeve 132 and extend radially inward into sliding engagement with helical slots 146 formed in the drive hub 134. As the drive sleeve 132 displaces longitudinally, the engagement between the fasteners 144 and the helical slots 146 causes the drive hub 134 to rotate. As described more fully below, rotation of the drive hub 134 causes the iris segments 106 to radially extend or retract, depending on the direction of the rotation.

Note that each of the iris segments 106 has upper and lower pins 106*a,b* projecting longitudinally therefrom. The upper pins 106*a* are slidingly received in slots 148 formed in the housing 72. The lower pins 106*b* are slidingly received in slots 150 formed in the drive plate 126. The lower pins 106*b* are also received in slots 152 formed in the drive hub 134.

Because the lower pins 106*b* are received in the slots 152 of the drive hub 134, the iris segments 106 will rotate with the drive hub 134. Thus, the iris segments 106 rotate in response to relative longitudinal displacement between the housing 72 and the collets 84, and the resulting rotation of the drive hub 134.

The slots 148, 150 in the housing 72 and drive plate 126 are configured so that, in response to relative rotation between the iris segments 106 and the housing 72, the iris segments 106 are displaced radially inward or outward, depending on the direction of the rotation. The manner in which the iris segments 106 are radially displaced due to their engagement with the slots 148, 150 can be more clearly seen in FIGS. 12A-C.

Figure 12A:
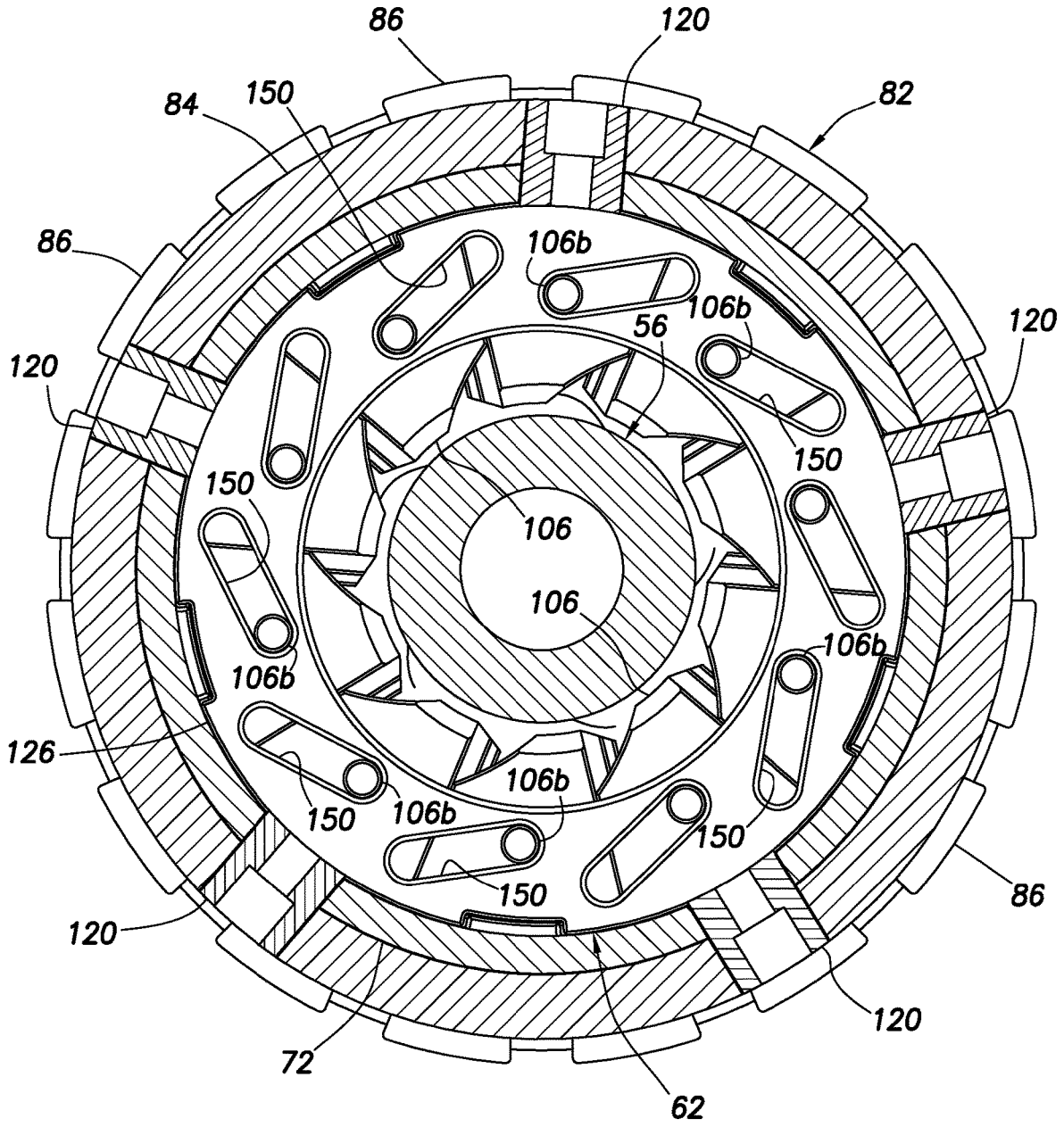
FIGS. 12A-C are representative cross-sectional views of the iris mechanism in respective retracted, partially extended and fully extended configurations.
Figure 12B:
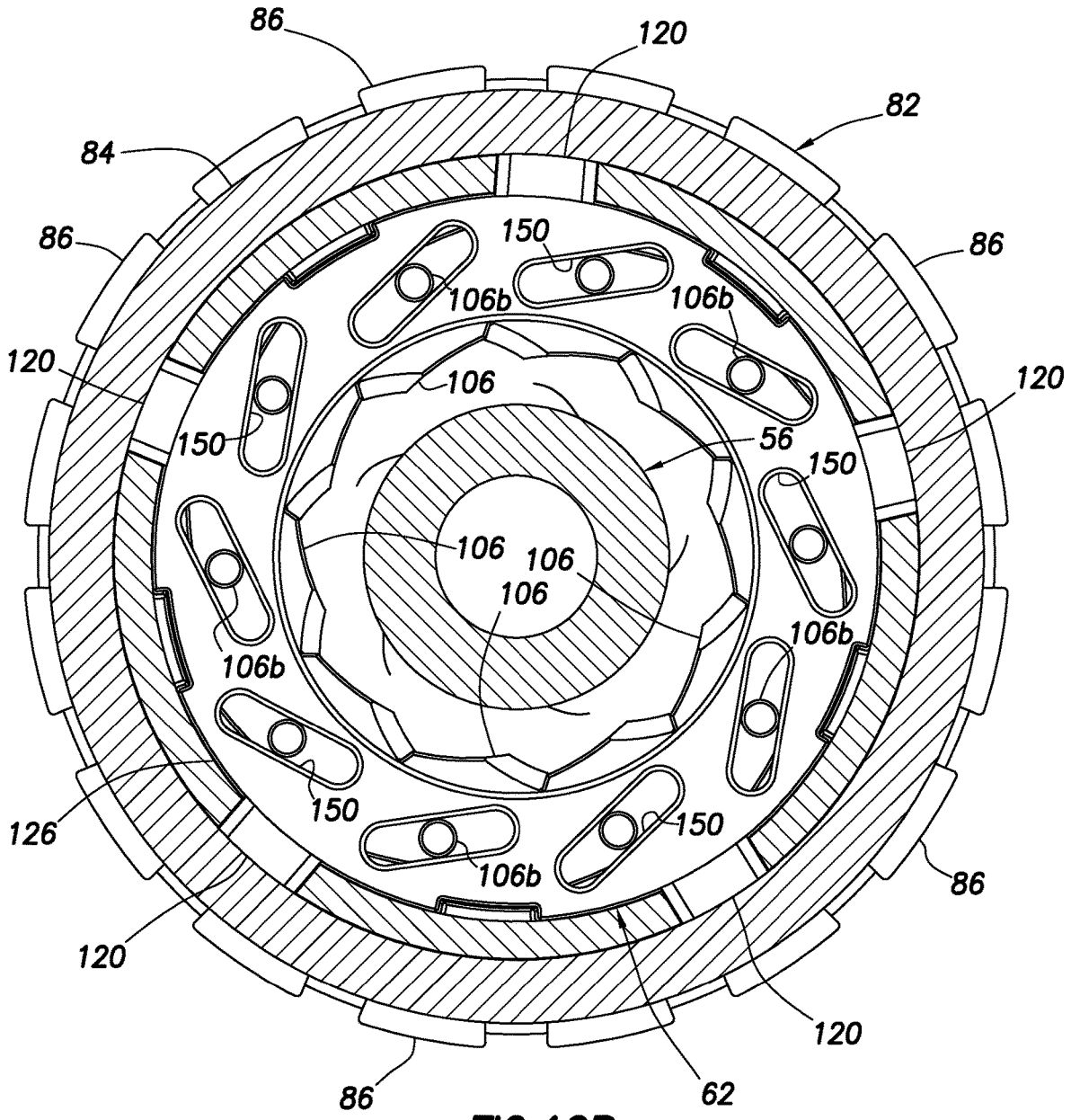
Figure 12C:
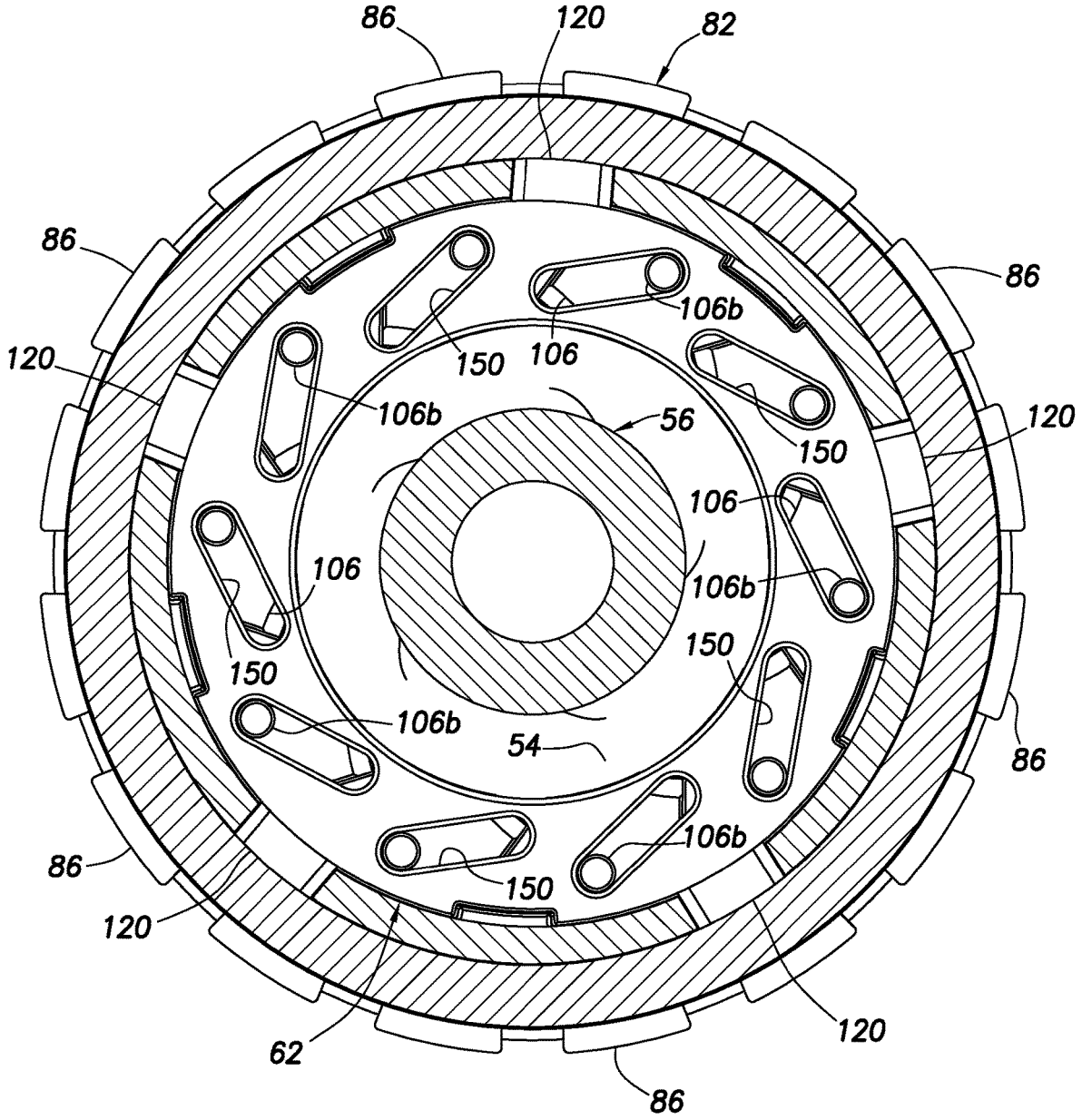

FIGS. 12A-C are representative cross-sectional views of the iris mechanism 62 in respective retracted, partially extended and fully extended configurations, taken along line 12-12 of FIG. 11B. The slots 150 in the drive plate 126 are visible in FIGS. 12A-C. The slots 148 in the housing 72 are similarly configured.

Note that the slots 150 are inclined radially and circumferentially so that, as the iris segments 106 rotate relative to the housing 72 and drive plate 126, the iris segments 106 are displaced radially inward or outward, depending on the direction of rotation. Thus, the iris segments 106 displace both rotationally and radially relative to the housing 72 and drive plate 126 in changing between the retracted, partially extended and fully extended configurations of the iris mechanism 62.

In FIG. 12A, the iris mechanism 62 is in its retracted configuration. This retracted configuration is used when the replaceable assembly 40 is being conveyed on the running tool 56 during the installation and retrieval operations. The collets 84 are in their fully downward longitudinal position relative to the housing 72 in this retracted configuration.

In FIG. 12B, the iris mechanism 62 is in a partially extended configuration. This configuration occurs when the collets 84 have engaged the latch 46 (see FIG. 9) and the replaceable assembly 40 is then displaced further downward, so that the collets 84 are displaced longitudinally upward relative to the housing 72 against the biasing forces exerted by the springs 116, 140 (see FIG. 11B).

In FIG. 12A, the iris mechanism 62 is in its fully extended configuration, in which the iris segments 106 are radially outwardly extended (the iris segments 106 are only visible in FIG. 12C through the slots 150). In this extended configuration, the iris segments 106 do not inhibit displacement of the running tool 56 (or any of the remainder of the tubular string 20) longitudinally through the passage 54. The iris mechanism 62 is in this extended configuration when the latch 46 is set, as described more fully below.

Figure 13:
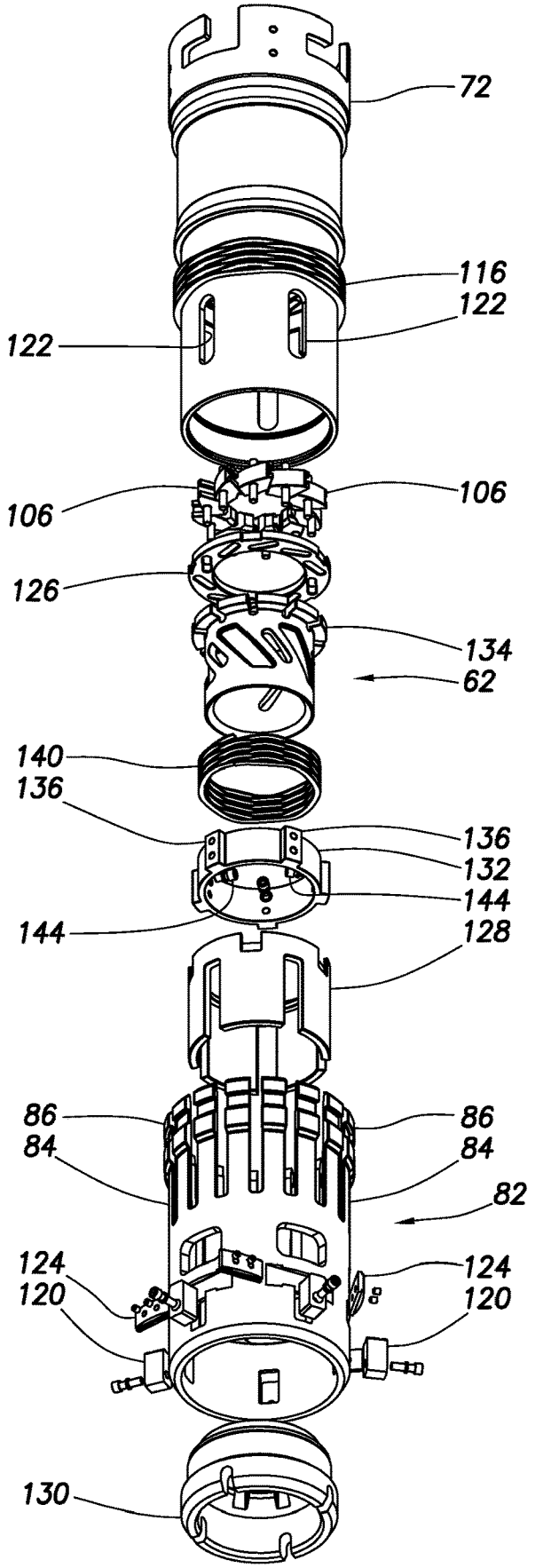
FIG. 13 is a representative exploded perspective view of the collet and iris mechanisms section of the pressure control device.

FIG. 13 is a representative exploded perspective view of the iris and collet mechanisms 62, 82. In this view, the manner in which the various components of these mechanisms 62, 82 are arranged together can be more clearly seen.

Figure 14:
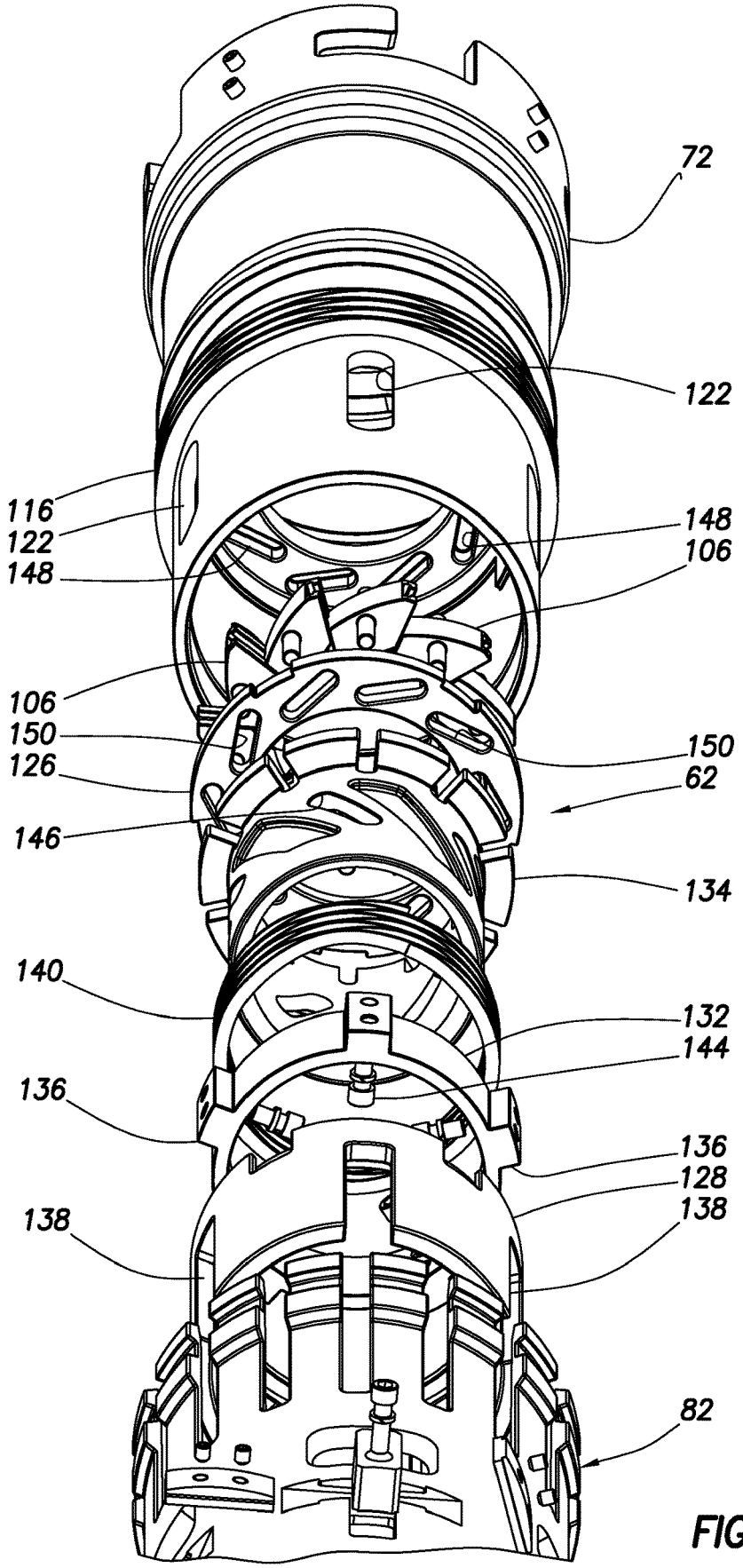
FIG. 14 is a representative exploded perspective view of the iris mechanism.

FIG. 14 is a representative exploded perspective view of the iris mechanism 62. In this view, the arrangement of the slots 148 in the housing 72 can be seen.

Figure 15:
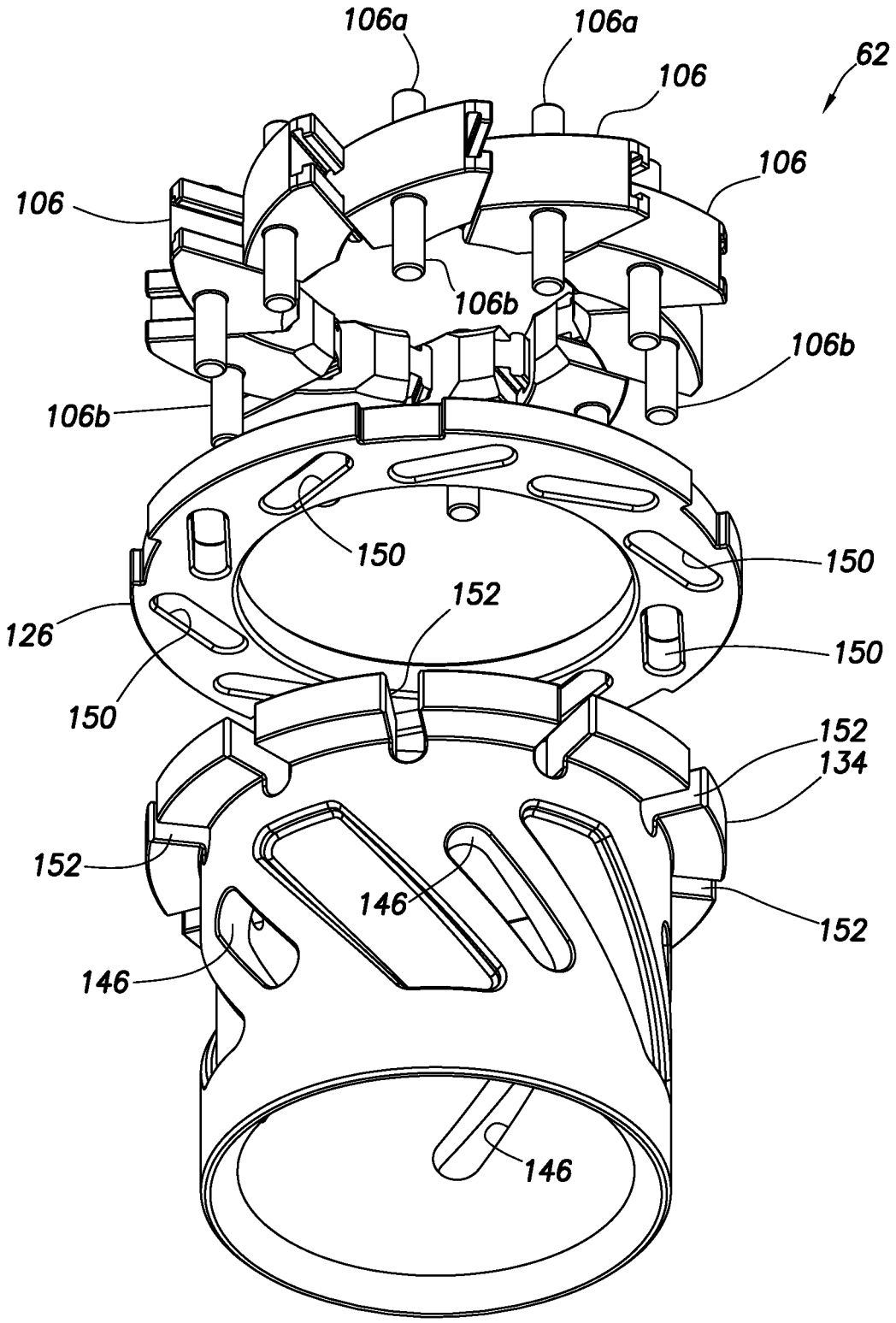
FIG. 15 is a representative exploded perspective view of components of the iris mechanism.

FIG. 15 is a representative exploded perspective view of certain components of the iris mechanism 62. It will be appreciated from this view that the lower pins 106*b* on the iris segments 106 are free to displace radially in the slots 152 of the drive hub 134. As the drive hub 134 rotates, the iris segments 106 rotate with the drive hub 134, and the configurations of the slots 150 (and slots 148 in the housing 72 (see FIG. 14)) cause the iris segments 106 to displace radially inward or outward, depending on the direction of the rotation.

Figure 16:
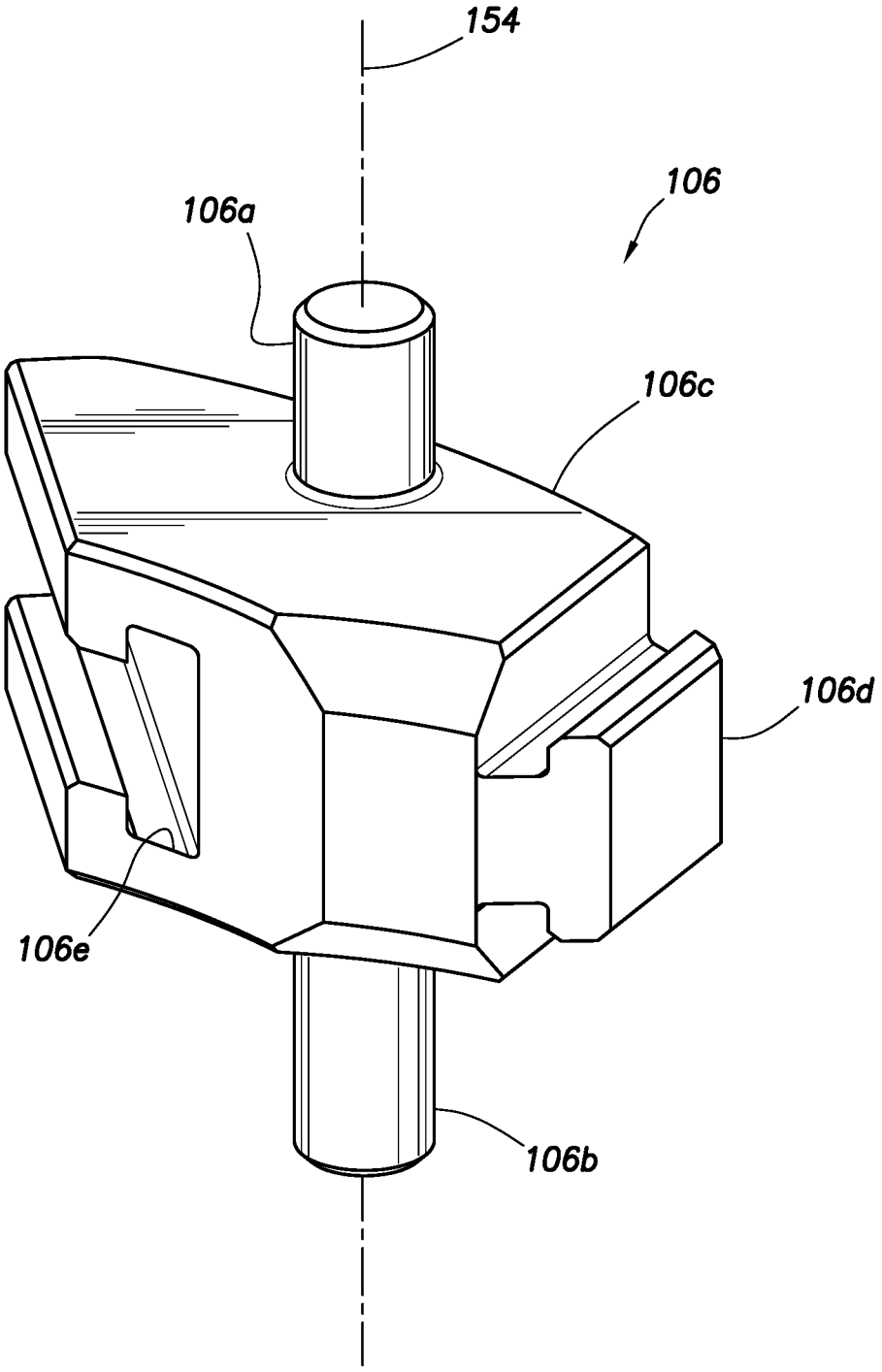
FIG. 16 is a representative perspective view of a segment of the iris mechanism.

Referring additionally now to FIG. 16, a perspective view of an individual iris segment 106 of the iris mechanism 62 is representatively illustrated. The iris segment 106 has a body 106*c* from which the pins 106*a,b* extend longitudinally in opposite directions.

A "T"-shaped slider 106*d* is formed on one side of the body 106*c*, and a complementarily-shaped slot 106*e* is formed on another side of the body 106*c*. The slider 106*d* of each iris segment 106 slidingly engages the slot 106*e* of a next adjacent iris segment 106, so that all of the iris segments cooperate in displacing between the retracted and extended configurations.

In other examples, the slider 106*d* and slot 106*e* may be dovetail, trapezoidal or otherwise-shaped. The scope of this disclosure is not limited to any particular shapes of the iris segment 106 or any of its components.

Note that the slider 106*d* and the slot 106*e* are not arranged in parallel. Instead, the slider 106*d* and slot 106*e* are angularly offset, in order to accommodate rotation of the iris segments 106 about the pins 106*a,b* as the iris segments displace radially inward and outward.

The pins 106*a,b* define an axis 154 about which each iris segment 106 rotates as it displaces radially. Note that the axes 154 of the iris segments 106 are parallel to an axis 156 (see FIG. 18) of the passage 54 that extends longitudinally through the releasable assembly 40.

Figure 17:
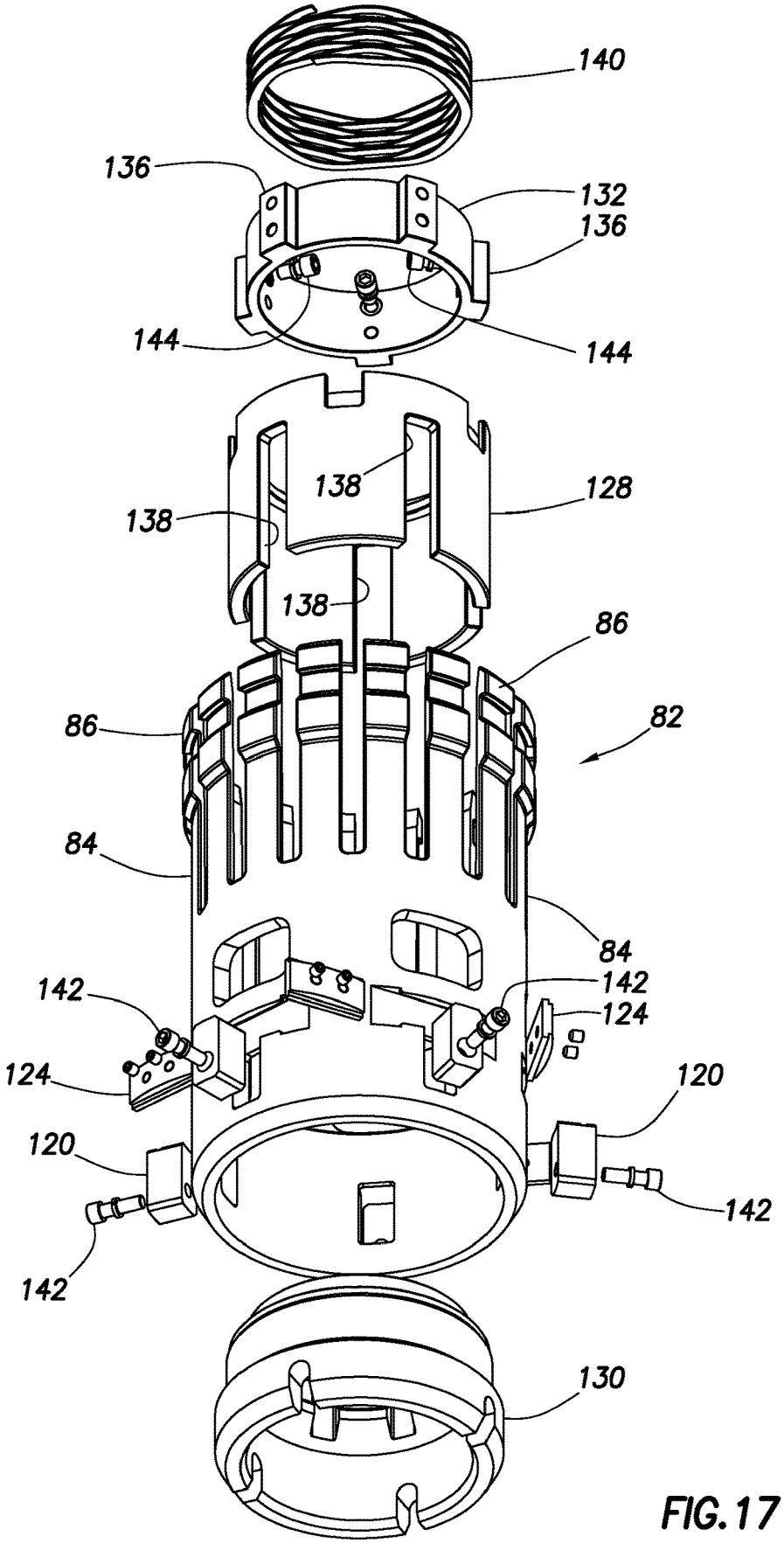
FIG. 17 is a representative exploded perspective view of the collet mechanism.

Referring additionally now to FIG. 17, a representative exploded perspective view of the collet mechanism 82 and associated components of the iris mechanism 62 is representatively illustrated. The keys 136 on the drive sleeve 132 are slidingly received in the longitudinal slots 138 of the guide sleeve 128, and the drive sleeve 132 is downwardly biased by the spring 140. The keys 120 and fasteners 142, 144 ensure that the collets 84 displace longitudinally with the drive sleeve 132.

Figure 18:
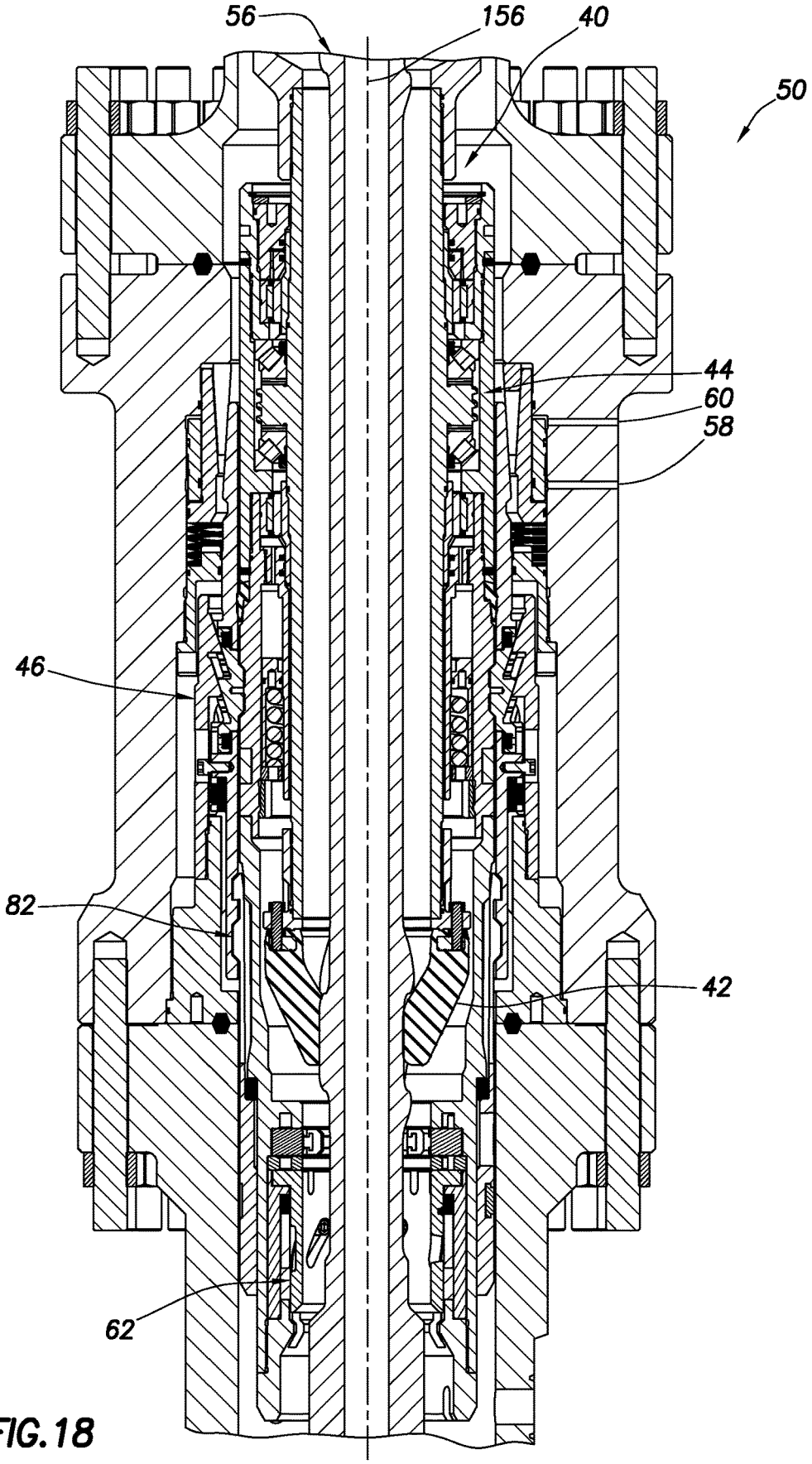
FIG. 18 is a representative cross-sectional view of the replaceable assembly set in the outer housing.

Referring additionally now to FIG. 18, a cross-sectional view of the replaceable assembly 40 set in the outer housing 52 is representatively illustrated. In this set configuration, the latch 46 prevents relative longitudinal and rotational displacement between the replaceable assembly 40 and the outer housing 52.

The set configuration occurs in response to the predetermined downwardly directed force being applied to the replaceable assembly 40 after the collet assembly 82 has engaged the latch 46. Thus, the application of the predetermined downwardly directed force to the replaceable assembly 40 both sets the latch 46 and actuates the iris mechanism 62 to its fully expanded configuration.

Figure 19:
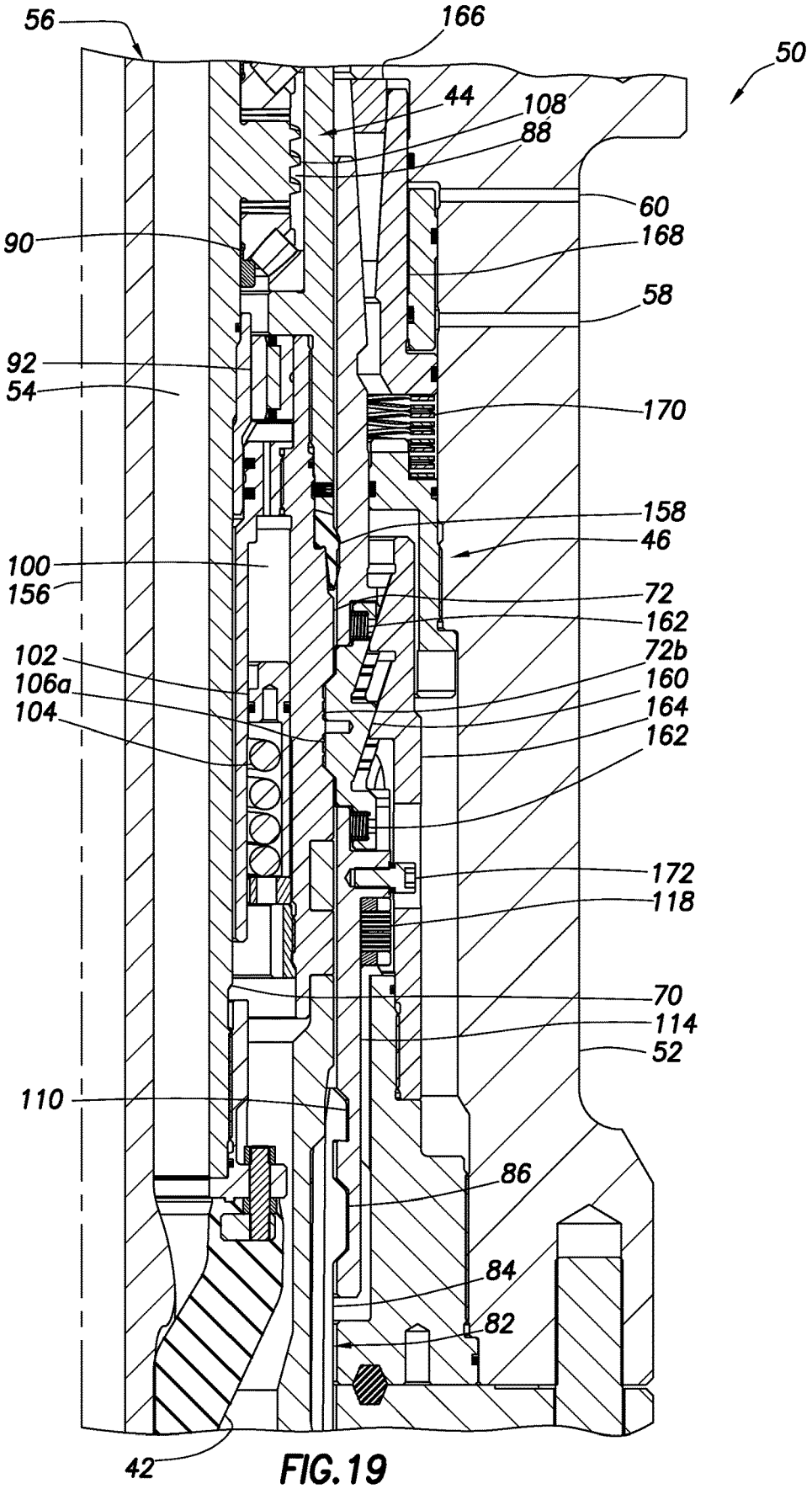
FIG. 19 is a representative cross-sectional view of a latch section releasably securing the replaceable assembly in the outer housing.

Referring additionally now to FIG. 19, a representative cross-sectional view of the latch 46 releasably securing the replaceable assembly 40 in the outer housing 52 is representatively illustrated. The latch 46 is set as depicted in FIG. 19, and so relative longitudinal and rotational displacement between the outer housing 52 and the replaceable assembly 40 is prevented (although the annular seals 42 and inner mandrel 70 can still rotate in the releasable assembly 40). Note that the replaceable assembly 40 is also sealingly received in the latch 46, due to an annular seal 158 carried on the housing 72 being sealingly engaged in the setting sleeve 114.

The latch 46 includes circumferentially distributed and radially displaceable grip members or slips 160 received in the setting sleeve 114. The slips 160 displace longitudinally with the setting sleeve 114.

The slips 160 are biased radially outward by springs 162. However, when the setting sleeve 114 and slips 160 displace downward as viewed in FIG. 19, the slips 160 are also displaced radially inward due to cooperation between inclined surfaces formed on the slips 160 and in a slip housing 164 of the latch 46.

As depicted in FIG. 19, the setting sleeve 114 has been displaced downward along with the releasable assembly 40 after the collet profiles 86 have engaged the internal profile 110 in the setting sleeve 114. The slips 160 have displaced downward with the setting sleeve 114, and have displaced radially inward as a result of the inclined surfaces on the slips 160 and in the slip housing 164.

A radially reduced gripping surface 160*a* in each of the slips 160 now grippingly engages a radially recessed external surface 72*b* on the housing 72. The gripping surfaces 160*a* may be provided with inner serrations, teeth, roughness, embedded particles or other structures suitable for grippingly engaging the external surface 72*b*.

The engagement of the slips 160 with the external surface 72*b* prevents relative rotation and longitudinal displacement between the housing 72 of the replaceable assembly 40, and the latch 46 and outer housing 52 of the pressure control device 50. Note that prevention of relative longitudinal displacement is provided by the reception of the slips 160 in the radially recessed portion of the housing 72, whether or not the surfaces 160*a* grippingly engage the external surface 72*b*.

An upper end of the setting sleeve 114 is externally tapered. When the setting sleeve 114 displaces downward, a radially extendable and retractable setting ring 166 is permitted to radially retract. The setting ring 166 has internal and external tapered surfaces.

A piston 168 sealingly and reciprocably positioned in the outer housing 52 has a tapered internal surface that engages the tapered external surface of the setting ring 166. The piston 168 is biased upward by one or more springs 170.

As the setting sleeve 114 displaces downward, the setting ring 166 radially retracts and the piston 168 displaces upward somewhat, due to the biasing force exerted by the springs 170 and the inclined surfaces engaged between the setting ring 166 and the piston 168. Because the setting ring 166 has been radially retracted and the piston 168 now radially outwardly supports the setting ring 166 in its radially retracted configuration, the setting sleeve 114 cannot now displace upward to unset the latch 46. Thus, the setting ring 166, the springs 170, and the tapered surfaces on and in the setting sleeve 114 and piston 168 function as a locking mechanism to prevent unsetting of the latch 46 after it has been set.

Figure 20A:
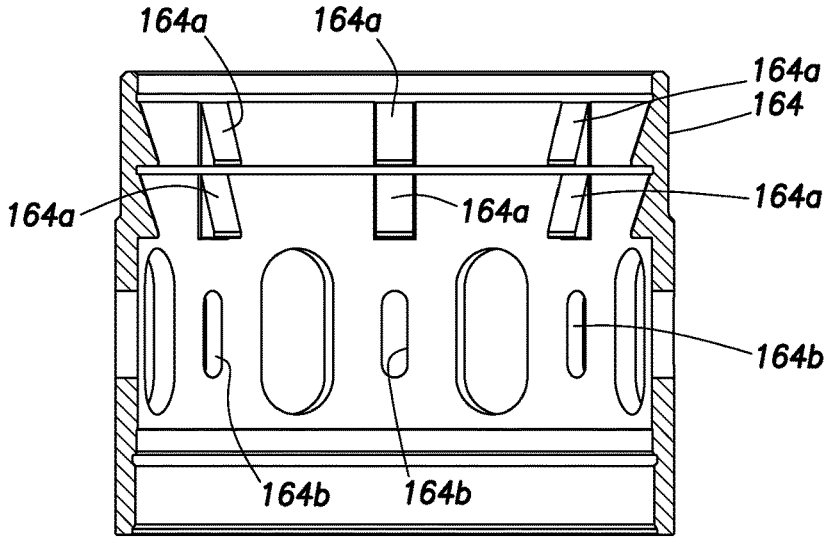
FIGS. 20A-C are representative cross-sectional and perspective views of components of the latch section.
Figure 20C:
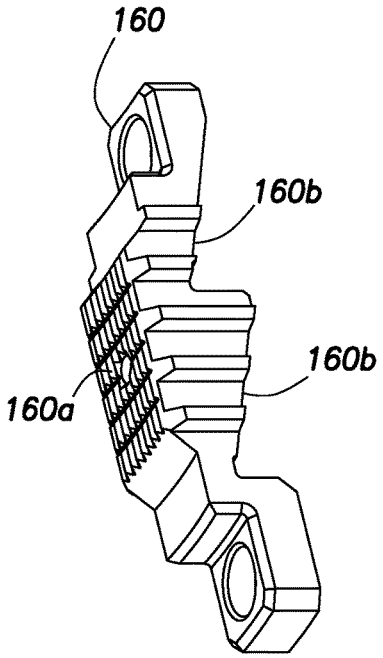
Figure 20B:
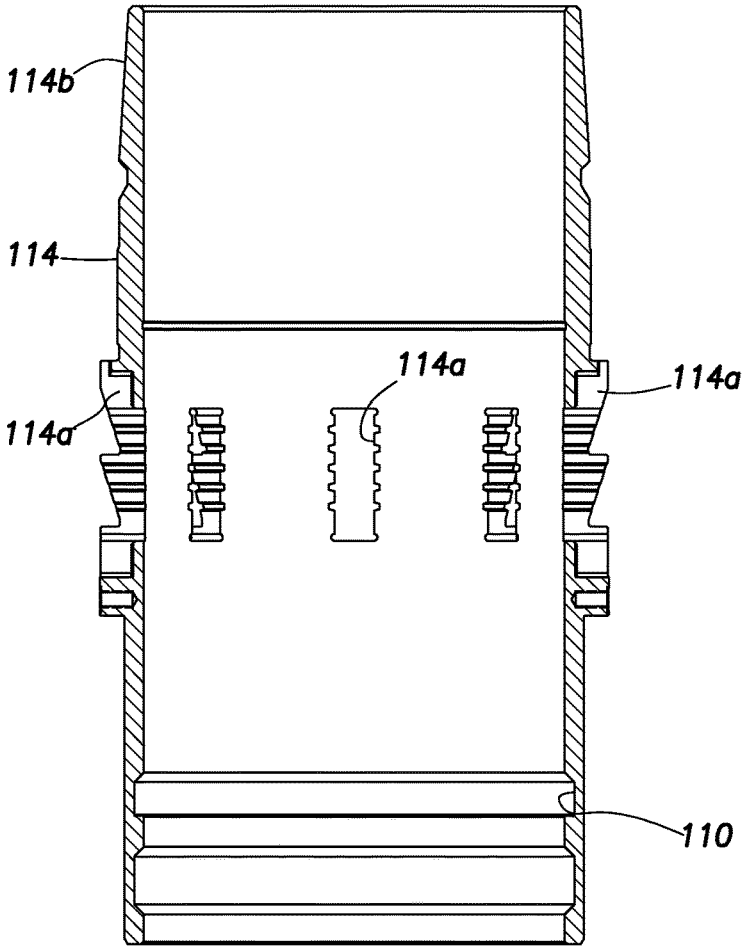

Referring additionally now to FIGS. 20A-C, cross-sectional and perspective views of components of the latch 46 are representatively illustrated. Specifically, the slip housing 164 is depicted in FIG. 20A, the setting sleeve 114 is depicted in FIG. 20B and one of the slips 160 is depicted in FIG. 20C.

In FIG. 20A it may be seen that the slip housing 164 includes multiple circumferentially spaced apart sets of internal inclined surfaces 164*a*. The sets of inclined surfaces 164*a* are rotationally aligned with longitudinally elongated slots 164*b* formed in the slip housing 164.

In FIG. 20B it may be seen that the setting sleeve 114 includes multiple circumferentially spaced apart grooved openings 114*a* for receiving the slips 160 therein. The setting sleeve 114 also includes an upper tapered external surface 114*b* for cooperative engagement with the setting ring 166.

Fasteners 172 (see FIG. 19) are threaded into circumferentially spaced apart holes 114*c* in the setting sleeve 114 and are slidingly received in the slots 164*b* in the slip housing 164 to prevent relative rotation between the setting sleeve 114 and the slip housing 164. This maintains rotational alignment between the internal inclined surfaces 164*a* and the slips 160 disposed in the openings 114*a*.

In FIG. 20C it may be seen that the slips 160 have external inclined surfaces 160*b* formed thereon for cooperative engagement with the inclined surfaces 164*a* of the slip housing 164. When the setting sleeve 114 and slips 160 are displaced downward relative to the slip housing 164 to set the latch 46, the cooperative engagement between the inclined surfaces 160*b*, 164*a* will cause the slips 160 to displace radially inward. Conversely, when the setting sleeve 114 and slips 160 are displaced upward relative to the slip housing 164 to unset the latch 46, separation between the inclined surfaces 160*b*, 164*a* will allow the slips 160 to be displaced radially outward by the springs 162 (see FIG. 19).

Figure 21:
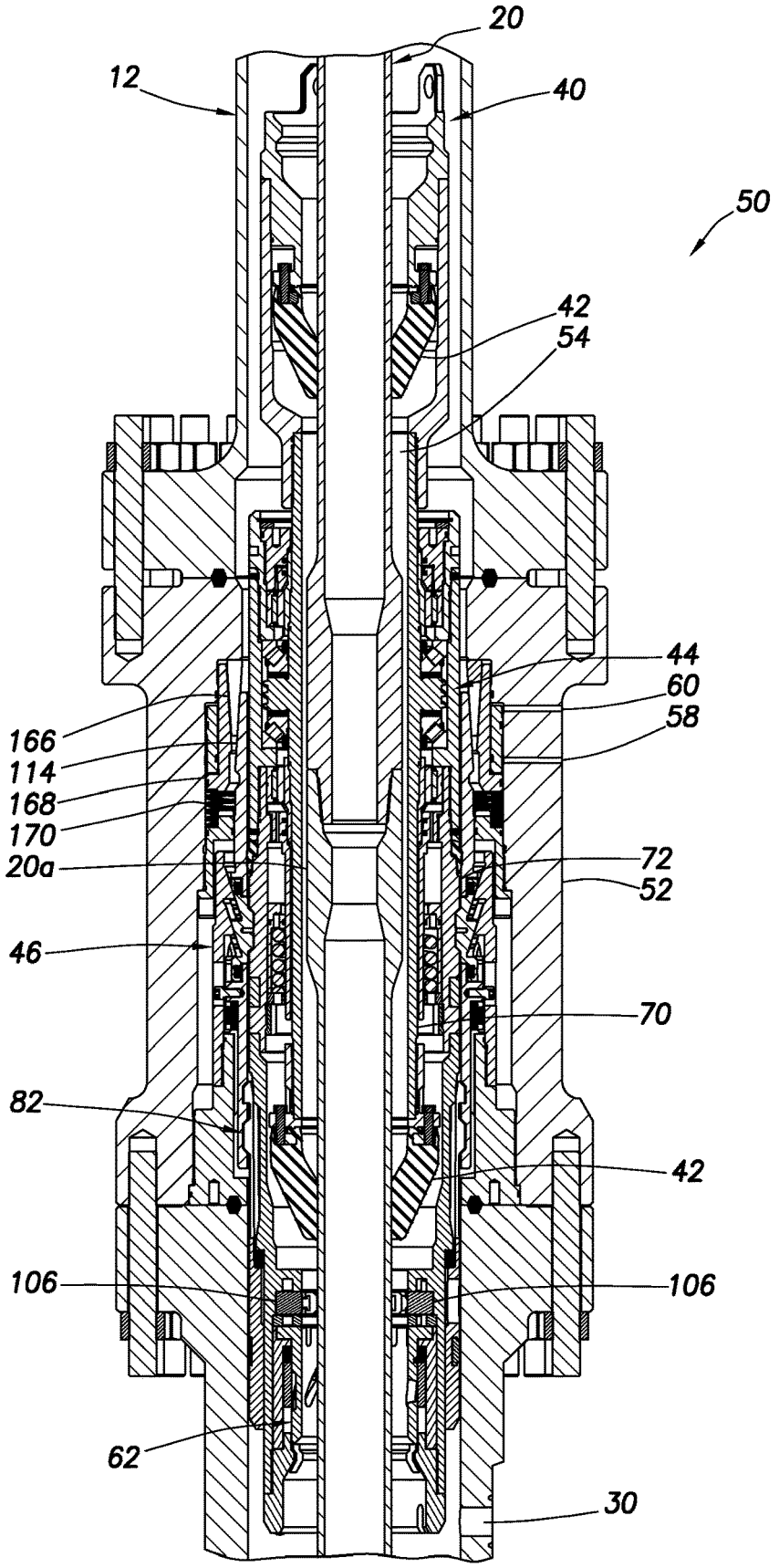
FIG. 21 is a representative cross-sectional view of the pressure control device during drilling operations.

Referring additionally now to FIG. 21, a representative cross-sectional view of the pressure control device 50 during drilling operations is representatively illustrated. The pressure control device 50 is in the set configuration of FIG. 18, and the tubular string 20 is received in the passage 54 and sealingly engaged by the annular seals 42.

When the tubular string 20 is rotated (for example, to rotate the drill bit 24 of FIG. 1), friction between the annular seals 42 and the tubular string 20 will cause the annular seals to rotate with the tubular string. Such rotation is provided for by the bearing assembly 44.

The iris mechanism 62 is in its fully expanded configuration. The iris segments 106 do not inhibit displacement of the tubular string 20 through the passage 54, and even allow radially enlarged tool joints 20*a* to pass through the iris mechanism 62.

The latch 46 remains set throughout the drilling operation or other operations. The cooperative engagement between the tapered setting ring 166 and each of the setting sleeve 114 and piston 168, assisted by the springs 170, ensures that the latch 46 will not inadvertently become unset during drilling or other operations.

When it is desired to unset the latch 46 and thereby allow retrieval of the releasable assembly 40 from the outer housing 52, the running tool 56 (or another running tool) can again be connected in the tubular string 20 (or another tubular string) and run into the replaceable assembly 40.

Figure 22:
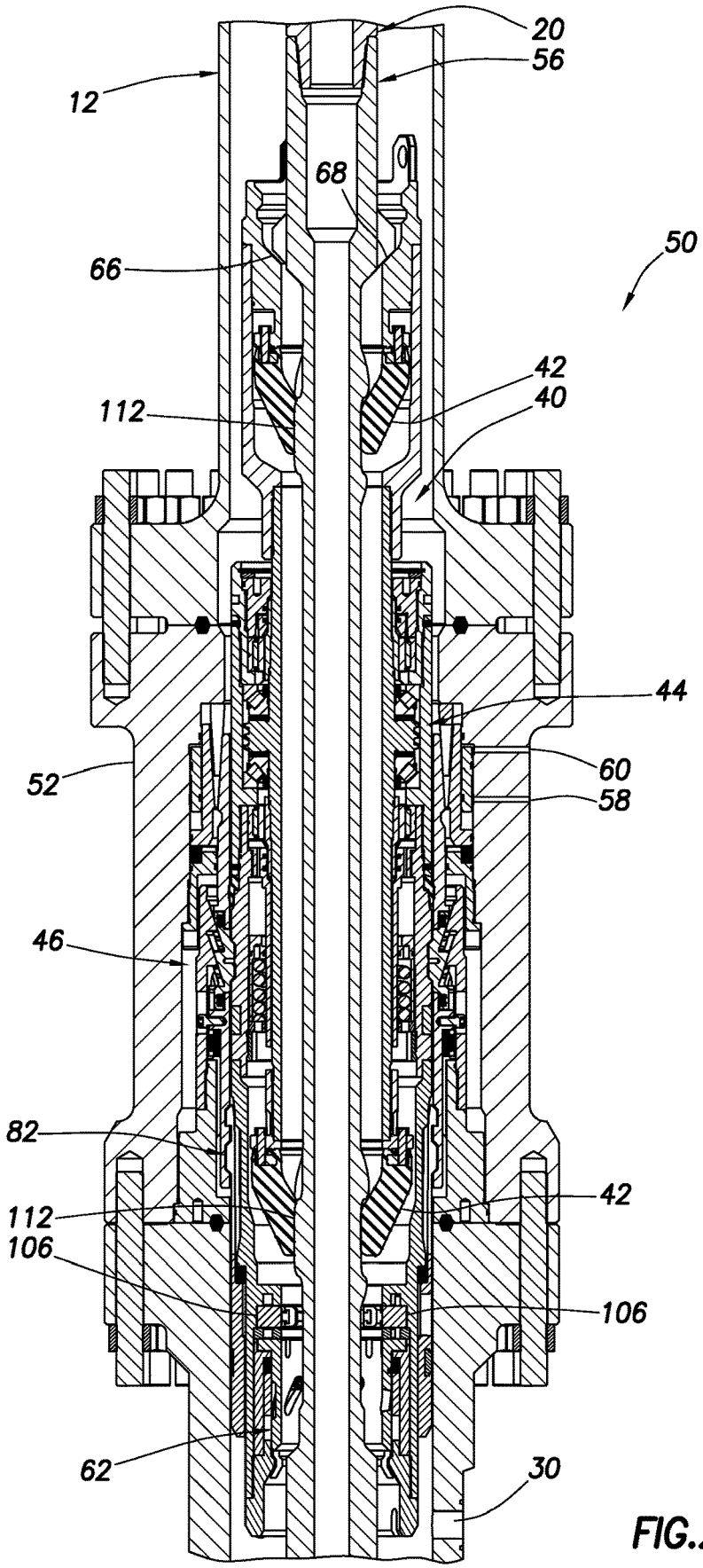
FIG. 22 is a representative cross-sectional view of the pressure control device during a retrieval operation.

FIG. 22 representatively illustrates a cross-sectional view of the pressure control device 52 during such a retrieval operation.

The flutes 112 on the running tool 56 are in the annular seals 42, so that no pressure differential is allowed to build up across the annular seals 42. The external shoulder 66 on the running tool 56 is engaged with the internal shoulder 68 in the releasable assembly 40, as depicted in FIG. 22.

A downwardly directed force can now be applied from the running tool 56 to the replaceable assembly 40 (e.g., by slacking off on the tubular string 20 at the rig 14 (see FIG. 1)). This downwardly directed force ensures that the running tool 56 is properly positioned relative to the releasable assembly 40, prior to unsetting the latch 46.

Figure 23:
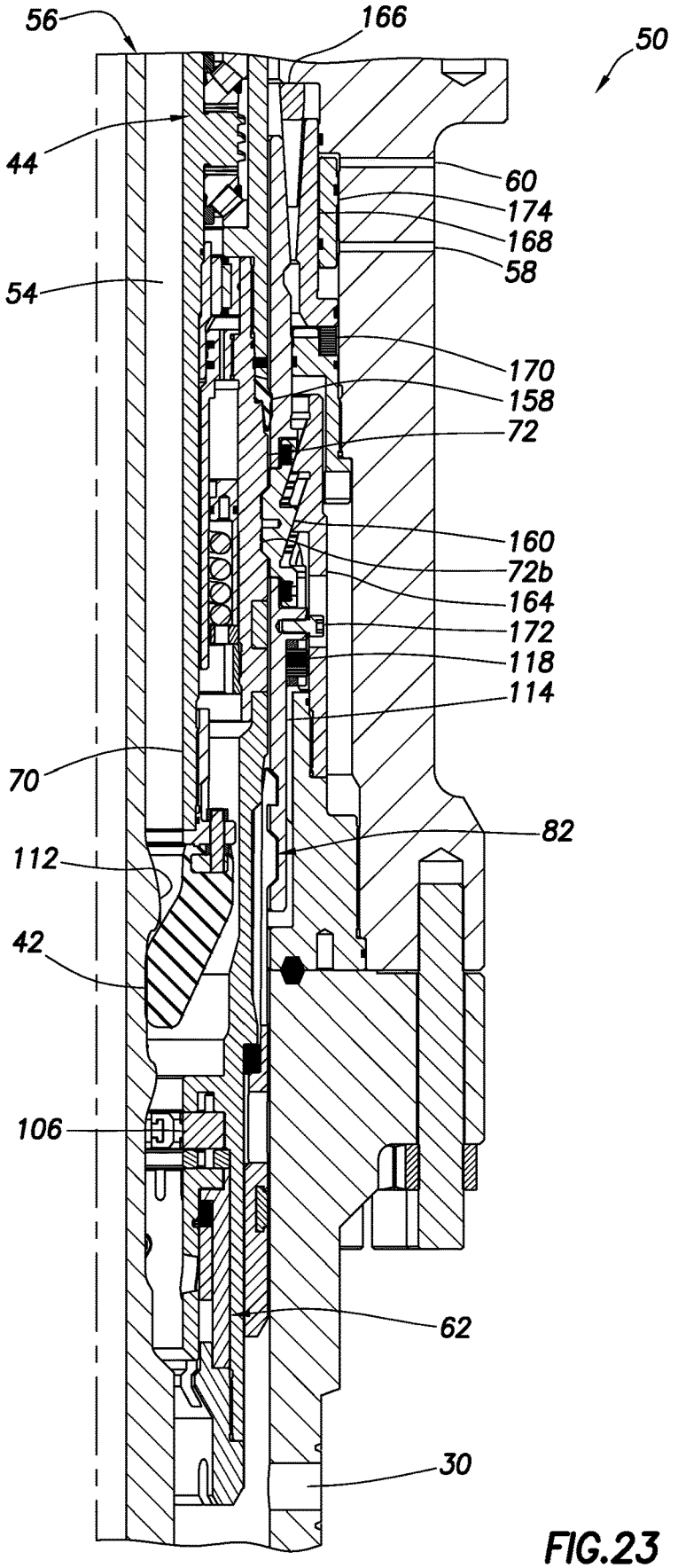
FIG. 23 is a representative cross-sectional view of a section of the pressure control device as a latch is being disengaged.

Referring additionally now to FIG. 23, a representative cross-sectional view of a section of the pressure control device 50 as the latch is being unset is representatively illustrated. FIG. 23 depicts the latch 46 as pressure is applied to the release port 58 to thereby downwardly displace the piston 168, compressing the spring 170.

If the application of increased pressure to the release port 58 is unsuccessful in downwardly displacing the piston 168, increased pressure can be applied to the backup release port 60 to cause a backup piston 174 to displace the piston 168 downward and compress the spring 170.

The setting ring 166 can now radially enlarge to permit the setting sleeve 114 to upwardly displace. The setting sleeve 114 is not yet displaced upward as viewed in FIG. 23, because the slips 160 remain engaged with the radially reduced outer surface 72*b* on the housing 72.

Figure 24:
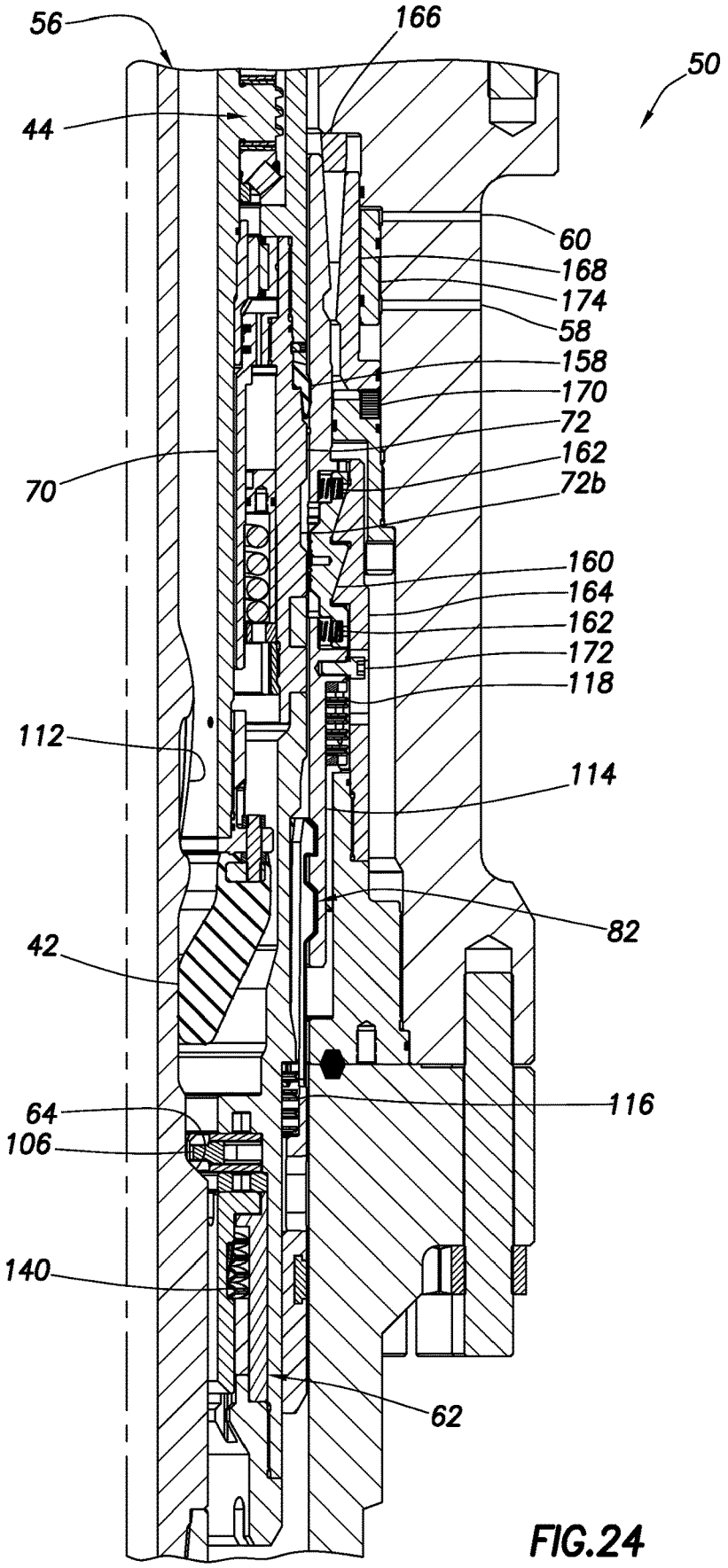
FIG. 24 is a representative cross-sectional view of the latch in a disengaged configuration.

Referring additionally now to FIG. 24, a representative cross-sectional view of the latch 46 in its unset configuration is representatively illustrated. The previously applied downwardly directed force has been removed, and the releasable assembly 40 has been displaced upward somewhat relative to the outer housing 52, while pressure remains applied to the release port 58.

As the downwardly directed force applied to the releasable assembly 40 is reduced, the springs 116, 140 cause the iris mechanism 62 to be actuated to its radially retracted configuration. Thus, the iris segments 106 are displaced radially inward to prevent the external shoulder 64 on the running tool 56 from displacing upward through the iris mechanism 62.

The spring 118 causes the setting sleeve 114 and slips 160 to displace upward. The setting sleeve 114 can displace upward due to the setting ring 166 having previously been allowed to radially expand (when the piston 168 is displaced downward in response to the pressure applied to the release port 58).

Such upward displacement of the slips 160 relative to the slip housing 164, assisted by the springs 162, causes the slips 160 to displace radially outward and out of engagement with the housing 72. At this point, the releasable assembly 40 can be conveyed upwardly out of the outer housing 52 and retrieved from the riser string 12.

Figure 25:
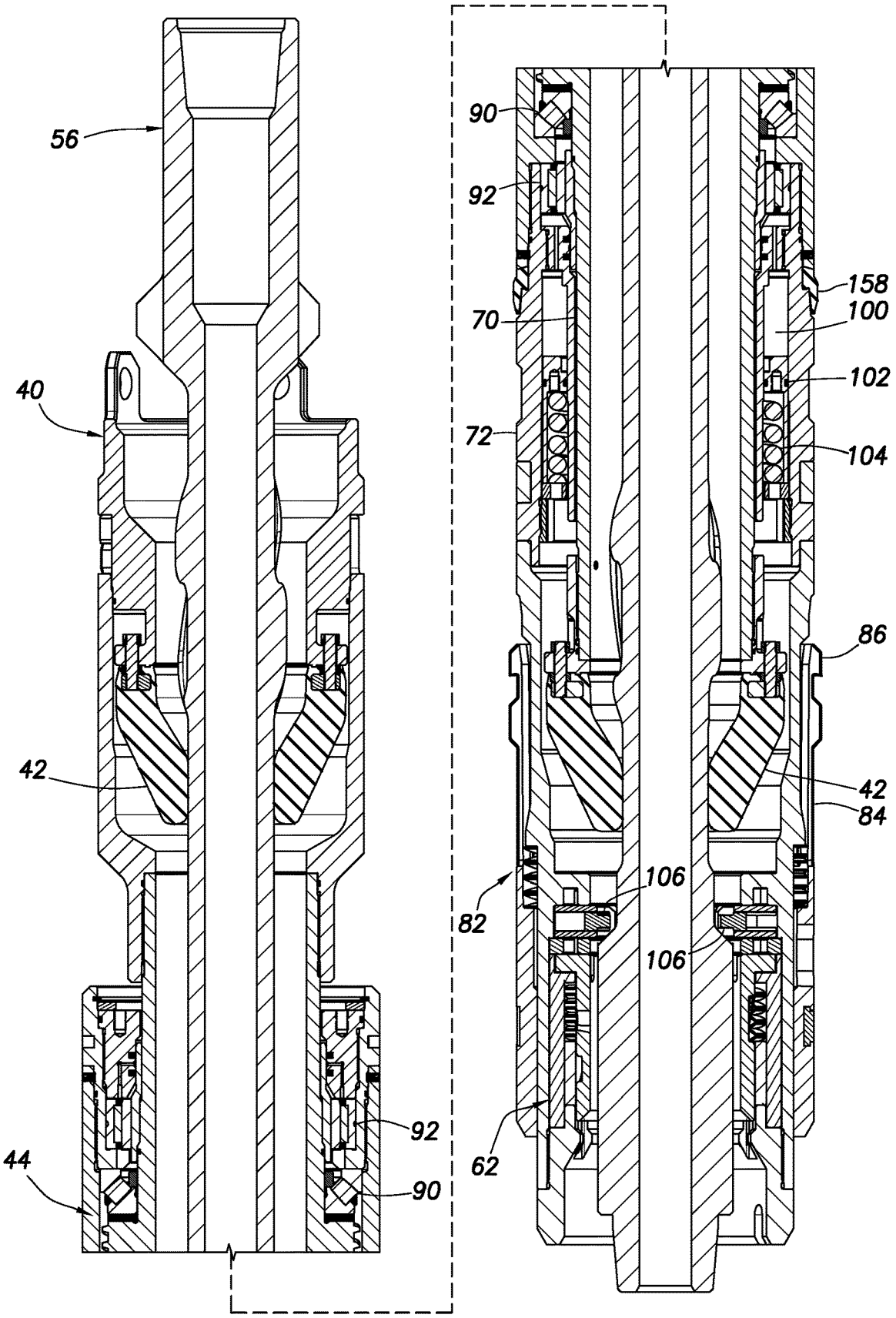
FIG. 25 is a representative cross-sectional view of the replaceable assembly and running tool as retrieved from the outer housing.

Referring additionally now to FIG. 25, a representative cross-sectional view of the replaceable assembly 40 and running tool 56 as retrieved from the outer housing 52 is representatively illustrated. The releasable assembly 40 and running tool 56 are in substantially the same configuration as depicted in FIG. 24, but are retrieved from the riser string 12. Maintenance or replacement of the releasable assembly 40 can now be performed.

It may now be fully appreciated that the above disclosure provides significant advancements to the art of constructing and operating pressure control devices and running tools therefor. The above examples provide for convenient and reliable installation, operation and retrieval of components of pressure control devices.

In one respect, the above disclosure provides to the art a method of conveying a replaceable assembly 40 between latched and unlatched configurations with an outer housing 52. In one example, the method comprises connecting the replaceable assembly 40 to a running tool 56, the replaceable assembly 40 being thereby conveyed with the running tool 56; disconnecting the replaceable assembly 40 from the running tool 56; and at least one of the connecting and the disconnecting steps comprising actuating an iris mechanism 62 between extended and retracted configurations.

The actuating step may comprise rotating each of multiple segments 106 of the iris mechanism 62 about a respective first axis 154 that is parallel to a second axis 156 of a longitudinal passage 54 formed through the replaceable assembly 40. The segments 106 may rotate as the segments 106 displace radially relative to the longitudinal passage 54.

The replaceable assembly 40 may comprise at least one annular seal 42 that seals about a tubular (such as tubular string 20) positioned in a passage 54 formed longitudinally through the replaceable assembly 40. The replaceable assembly 40 may further comprise a bearing 90, 92 that permits relative rotation between the annular seal 42 and the outer housing 52.

The connecting step may comprise the iris mechanism 62 in the retracted configuration limiting relative displacement between the replaceable assembly 40 and the running tool 56.

A pressure control device 50 is also provided to the art by the above disclosure. In one example, the pressure control device 50 can comprise at least one annular seal 42 configured to seal about a tubular (such as tubular string 20) disposed in a longitudinal passage 54 formed through an outer housing 52 of the pressure control device 50; and a latch 46 that releasably secures the annular seal 42 relative to the outer housing 52, the latch 46 comprising at least one grip member (such as slips 160) that grips a surface 72*b* and prevents relative rotation when the grip member 160 engages the surface 72*b*.

The annular seal 42 may be connected to an outer housing 72 of a replaceable assembly 40, and the grip member 160 may grippingly engage the surface 72*b* on the replaceable assembly outer housing 72.

The replaceable assembly 40 may include at least one bearing 90, 92 that permits relative rotation between the annular seal 42 and the replaceable assembly outer housing 72.

The grip member 160 may displace between engaged and disengaged positions in response to relative displacement between the grip member 160 and the pressure control device outer housing 52.

The grip member 160 in the engaged position may prevent relative longitudinal displacement between the annular seal 42 and the pressure control device outer housing 52.

The grip member 160 may be displaceable with a setting sleeve 114 between engaged and disengaged positions, and a biasing device (such as spring 118) may prevent the setting sleeve 114 from displacing from the engaged position to the disengaged position. A biasing force exerted by the biasing device (such as spring 118) may be overcome by a predetermined pressure applied to the latch 46, which application of pressure permits the grip member 160 and setting sleeve 114 to displace to the disengaged position.

Also described above is a pressure control device 50 example that can include at least one annular seal 42 configured to seal about a tubular (such as tubular string 20) disposed in a longitudinal passage 54 formed through an outer housing 52 of the pressure control device 50, the annular seal 42 being connected to and rotatable with an inner mandrel 70, and at least one bearing 90, 92 that permits relative rotation between the annular seal 42 and the outer housing 52. At least one structure 88 rotates with the inner mandrel 70, the structure 88 including a flow inductive profile 108 exposed to a lubricant flow path 98 in communication with the bearing 90, 92.

The flow inductive profile 108 may comprise vanes on the inner mandrel 70, or a helical profile disposed in an annular section of the lubricant flow path 98.

The lubricant flow path 98 may be in communication with a lubricant chamber 100 in which pressure is maintained greater than pressure in the longitudinal passage 54.

The pressure control device 50 may include an iris mechanism 62 that selectively permits and prevents relative longitudinal displacement in at least one direction between the annular seal 42 and a running tool 56.

The pressure control device 50 may include a latch 46 that releasably secures the annular seal 42 relative to the outer housing 52, the latch 46 comprising at least one grip member 160 that grips a surface 72*b* and prevents relative rotation when the grip member 160 engages the surface 72*b*.

The pressure control device 50 may include a setting sleeve 114 displaceable between engaged and disengaged positions, and a biasing device (such as spring 170) that prevents the setting sleeve 114 from displacing from the engaged position to the disengaged position. A predetermined pressure applied to the latch 46 may overcome a biasing force exerted by the biasing device (such as spring 170) and permit the setting sleeve 114 to displace to the disengaged position.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A pressure control device, comprising:

a replaceable assembly comprising at least one annular seal configured to seal about a tubular disposed in a longitudinal passage formed through the replaceable assembly; and a pressure control device outer housing configured to receive the replaceable assembly, the outer housing comprising a latch that releasably secures the replaceable assembly within the pressure control device outer housing, the latch comprising at least one grip member which is configured to displace radially inward and grip a surface of the replaceable assembly in response to a predetermined downwardly directed force applied to the replaceable assembly, thereby prohibiting relative rotation between the surface and the pressure control device outer housing, wherein the grip member concurrently displaces longitudinally as the grip member displaces radially inward.

2. The pressure control device of claim 1, wherein the annular seal is rotatably mounted within a replaceable assembly outer housing, and wherein the surface is on the replaceable assembly outer housing.

3. The pressure control device of claim 2, wherein the replaceable assembly includes at least one bearing that permits relative rotation between the annular seal and the replaceable assembly outer housing.

4. The pressure control device of claim 1, wherein the grip member displaces between engaged and disengaged positions in response to relative displacement between the grip member and the pressure control device outer housing.

5. The pressure control device of claim 4, wherein the grip member in the engaged position prevents relative longitudinal displacement between the annular seal and the pressure control device outer housing.

6. The pressure control device of claim 1, wherein the grip member is displaceable with a setting sleeve between engaged and disengaged positions, and wherein a biasing device biases the setting sleeve from displacing from the engaged position to the disengaged position.

7. The pressure control device of claim 6, wherein a biasing force exerted by the biasing device is overcome by a predetermined pressure applied to the latch, which permits the grip member and setting sleeve to displace to the disengaged position.

8. A pressure control device, comprising:

a replaceable assembly comprising at least one annular seal, an inner mandrel, and a first outer housing, wherein the at least one annular seal is configured to seal about a tubular disposed in a longitudinal passage formed through the replaceable assembly, the annular seal being connected to and rotatable with the inner mandrel, and wherein at least one bearing permits relative rotation between the inner mandrel and the first outer housing; and a second outer housing configured to receive the replaceable assembly, the second outer housing comprising a latch that releasably secures the replaceable assembly within the second outer housing, the latch comprising at least one grip member which is configured to displace radially inward and grip a surface of the first outer housing in response to a predetermined downwardly directed force applied to the replaceable assembly, and thereby prohibit relative rotation between the first and second outer housings, wherein the grip member concurrently displaces longitudinally as the grip member displaces radially inward.

9. The pressure control device of claim 8, wherein at least one structure rotates with the inner mandrel, the structure including a flow inductive profile exposed to a lubricant flow path in communication with the bearing.

10. The pressure control device of claim 9, wherein the flow inductive profile comprises a helical profile disposed in an annular section of the lubricant flow path.

11. The pressure control device of claim 9, wherein the lubricant flow path is in communication with a lubricant chamber in which pressure is maintained greater than pressure in the longitudinal passage.

12. The pressure control device of claim 9, further comprising an iris mechanism that selectively permits and prevents relative longitudinal displacement in at least one direction between the annular seal and a running tool.

13. The pressure control device of claim 8, further comprising a setting sleeve displaceable between engaged and disengaged positions, and a biasing device that prevents the setting sleeve from displacing from the engaged position to the disengaged position, and wherein a predetermined pressure applied to the latch overcomes a biasing force exerted by the biasing device and permits the setting sleeve to displace to the disengaged position.

14. The pressure control device of claim 9, wherein the flow inductive profile comprises vanes on the inner mandrel.

* * * * *